US006212891B1

(12) United States Patent
Minta et al.

(10) Patent No.: US 6,212,891 B1
(45) Date of Patent: Apr. 10, 2001

(54) PROCESS COMPONENTS, CONTAINERS, AND PIPES SUITABLE FOR CONTAINING AND TRANSPORTING CRYOGENIC TEMPERATURE FLUIDS

(75) Inventors: Moses Minta, Sugar Land; Lonny R. Kelley, Houston; Bruce T. Kelley, Kingwood; E. Lawrence Kimble, Sugar Land; James R. Rigby, Kingwood; Robert E. Steele, Seabrook, all of TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/099,569

(22) Filed: Jun. 18, 1998

Related U.S. Application Data

(60) Provisional application No. 60/068,208, filed on Dec. 19, 1997.

(51) Int. Cl.[7] ..... F17C 13/00

(52) U.S. Cl. ..... 62/50.7; 62/905; 148/336; 220/749; 420/92

(58) Field of Search ..... 62/50.7, 905; 220/749; 148/336; 420/92

(56) References Cited

U.S. PATENT DOCUMENTS

| | | | | |
|---|---|---|---|---|
| 2,004,074 | * | 6/1935 | Kiley | 220/85 |
| 2,795,937 | * | 6/1957 | Sattler et al. | 62/1 |
| 3,097,294 | * | 7/1963 | Kubli et al. | 219/145 |
| 3,232,725 | * | 2/1966 | Secord et al. | 48/190 |
| 3,298,805 | * | 1/1967 | Secord et al. | 48/190 |
| 3,477,509 | * | 11/1969 | Arendt | 166/252 |
| 3,745,322 | * | 7/1973 | Ito et al. | 219/137 |
| 3,853,611 | * | 12/1974 | Godai et al. | 117/205 |
| 3,864,918 | * | 2/1975 | Lorenz | 60/651 |
| 3,931,908 | * | 1/1976 | Cheyney | 220/71 |
| 3,990,256 | * | 11/1976 | May et al. . | |
| 4,024,720 | * | 5/1977 | Dimentberg et al. . | |
| 4,068,113 | * | 1/1978 | Godai et al. | 219/146.23 |
| 4,162,158 | * | 7/1979 | Hwang et al. | 75/124 |

(List continued on next page.)

FOREIGN PATENT DOCUMENTS

| | | | |
|---|---|---|---|
| 1522609 | * | 8/1978 | (GB) . |
| 7-331328 | * | 12/1995 | (JP) . |
| H8-176659 | * | 7/1996 | (JP) . |
| H8-295982 | * | 11/1996 | (JP) . |

OTHER PUBLICATIONS

Reference cited by the Taiwan Patent Office in counterpart application, reference title—"Electronic Welding Operation Handbook Part 1", 1994, pp. 33–41; English language translations of relevant portions as provided by Applicant's agent in Taiwan.*

Reference cited by the Taiwan Patent Office in counterpart application, reference title—"Welding Handbook vol. 2", 1993, pp. 190–195; English language translations of relevant portions as provided by Applicant's agent in Taiwan.*

K. E. Dorschu et al, "Development of a Filler Metal for a High–Toughness Alloy Plate Steel with a Minimum Yield Strength of 140 ksi", The Welding Journal, Dec. 1964, pp. 564s–575s.*

G. G. Saunders, "effect of Major Alloying Elements on the Toughness of high Strength Weld Metal", Welding Research International, vol. 7, No. 2, 1977, pp. 91–118.*

(List continued on next page.)

*Primary Examiner*—Ronald Capossela
(74) *Attorney, Agent, or Firm*—Marcy M. Lyles

(57) ABSTRACT

Process components, containers, and pipes are provided that are constructed from ultra-high strength, low alloy steels containing less than 9 wt % nickel and having tensile strengths greater than 830 MPa (120 ksi) and DBTTs lower than about −73° C. (−100° F.).

16 Claims, 12 Drawing Sheets

U.S. PATENT DOCUMENTS

| | | | | |
|---|---|---|---|---|
| 4,182,254 | * | 1/1980 | Secord | 114/74 |
| 4,257,808 | * | 3/1981 | Morris, Jr. et al. | 75/123 |
| 4,315,407 | * | 2/1982 | Creed et al. . | |
| 4,374,478 | * | 2/1983 | Secord | 73/836.31 |
| 4,459,929 | * | 7/1984 | Ffooks | 114/74 |
| 4,687,525 | * | 8/1987 | Biniasz et al. | 148/336 |
| 4,776,900 | * | 10/1988 | Yano et al. | 148/12 |
| 5,127,230 | * | 7/1992 | Neeser et al. | 62/7 |
| 5,183,633 | * | 2/1993 | Thierry et al. | 420/92 |
| 5,199,266 | * | 4/1993 | Johansen et al. | 62/8 |
| 5,325,673 | * | 7/1994 | Durr et al. . | |
| 5,484,098 | * | 1/1996 | Anttila et al. | 228/184 |
| 5,531,842 | * | 7/1996 | Koo et al. | 148/654 |
| 5,545,269 | * | 8/1996 | Koo et al. | 148/654 |
| 5,545,270 | * | 8/1996 | Koo et al. | 148/654 |
| 5,678,411 | * | 10/1997 | Matsumura et al. | 62/50.3 |
| 5,755,895 | * | 5/1998 | Tamehiro et al. | 148/336 |
| 5,762,119 | * | 6/1998 | Platz et al. | 141/231 |
| 5,798,004 | * | 8/1998 | Tamehiro et al. | 148/336 |
| 5,878,814 | * | 3/1999 | Breivik et al. | 166/267 |

OTHER PUBLICATIONS

S. G. Ladkany, "Composite Aluminum–Fiberglass Epoxy Pressure Vessels for Transportation of LNG at Intermediate Temperature", published in Advances in Cryogenic Engineering, Materials, vol. 28, (Proceedings of the 4th International Cryogenic Materials Conference), San Diego, CA, USA, Aug. 10–14, 1981, pp. 905–913.*

Roger Ffooks, "Natural Gas by Sea The Development of a New Technology", published 1983 (second edition) by Witherby & Co. Ltd., Chapter 14, especially pp. 162–164 and 175–176.*

R. J. Broeker, "A New Process for the Transportation of Natural Gas", International LNG Conference, Chicago, Apr. 1968, Session No. 5, Paper No. 30.*

C. P. Bennett, "Marine Transportation of LNG at intermediate temperature", CME, Mar. 1979, pp. 63–64.*

E. K. Faridany et al., "The Ocean Phoenix Pressure–LNG System", Gastech 1976, pp. 267–280.*

E. K. M. Faridany et al., "A Pressure LNG System", European Offshore Petroleum Conference & Exhibition, Oct. 21–24, 1980, vol. EUR 171, pp. 245–254.*

Broeker, R. J. "CNG and MLG–New Natural Gas Transportation Process", pp. 138–140, American Gas Journal, Jul. 1969.*

Prof. E. F. Fluggen and Dr. I. H. Backhaus, "Pressurised LNG—and the Utilisation of Small Gas Fields", Gastech 78 LNG/LPG Conference (Monte Carlo, Nov. 7–10, 1978) Proceedings, pp. 195–204.*

* cited by examiner

PROCESS COMPONENTS, CONTAINERS, AND PIPES SUITABLE FOR CONTAINING AND TRANSPORTING CRYOGENIC TEMPERATURE FLUIDS

This application claims the benefit of U.S. Provisional Application No. 60/068,208, filed Dec. 19, 1997.

FIELD OF THE INVENTION

This invention relates to process components, containers, and pipes suitable for containing and transporting cryogenic temperature fluids. More particularly, this invention relates to process components, containers, and pipes that are constructed from an ultra-high strength, low alloy steel containing less than 9 wt% nickel and having a tensile strength greater than 830 MPa (120 ksi) and a DBTT lower than about −73° C. (−100° F.).

BACKGROUND OF THE INVENTION

Various terms are defined in the following specification. For convenience, a Glossary of terms is provided herein, immediately preceding the claims.

Frequently in industry, there is a need for process components, containers, and pipes that have adequate toughness to process, contain, and transport fluids at cryogenic temperatures, i.e., at temperatures lower than about −40° C. (−40° F.), without failing. This is especially true in the hydrocarbon and chemical processing industries. For example, cryogenic processes are used to achieve separation of components in hydrocarbon liquids and gases. Cryogenic processes are also used in the separation and storage of fluids such as oxygen and carbon dioxide.

Other cryogenic processes used in industry, for example, include low temperature power generation cycles, refrigeration cycles, and liquefaction cycles. In low temperature power generation, the reverse Rankine cycle and its derivatives are typically used to generate power by recovering the cold energy available from an ultra-low temperature source. In the simplest form of the cycle, a suitable fluid, such as ethylene, is condensed at a low temperature, pumped to pressure, vaporized, and expanded through a work-producing turbine coupled to a generator.

There are a wide variety of applications in which pumps are used to move cryogenic liquids in process and refrigeration systems where the temperature can be lower than about −73° C. (−100° F.). Additionally, when combustible fluids are relieved into a flare system during processing, the fluid pressure is reduced, e.g., across a pressure safety valve. This pressure drop results in a concomitant reduction in temperature of the fluid. If the pressure drop is large enough, the resulting fluid temperature can be sufficiently low that the toughness of carbon steels traditionally used in flare systems is not adequate. Typical carbon steel may fracture at cryogenic temperatures.

In many industrial applications, fluids are contained and transported at high pressures, i.e., as compressed gases. Typically, containers for storage and transportation of compressed gases are constructed from standard commercially available carbon steels, or from aluminum, to provide the toughness needed for fluid transportation containers that are frequently handled, and the walls of the containers must be made relatively thick to provide the strength needed to contain the highly-pressurized compressed gas. Specifically, pressurized gas cylinders are widely used to store and transport gases such as oxygen, nitrogen, acetylene, argon, helium, and carbon dioxide, to name a few. Alternatively, the temperature of the fluid can be lowered to produce a saturated liquid, and even subcooled if necessary, so the fluid can be contained and transported as a liquid. Fluids can be liquefied at combinations of pressures and temperatures corresponding to the bubble point conditions for the fluids. Depending on the properties of the fluid, it can be economically advantageous to contain and transport the fluid in a pressurized, cryogenic temperature condition if cost effective means for containing and transporting the pressurized, cryogenic temperature fluid are available. Several ways to transport a pressurized, cryogenic temperature fluid are possible, e.g., tanker truck, train tankcars, or marine transport. When pressurized cryogenic temperature fluids are to be used by local distributors in the pressurized, cryogenic temperature condition, in addition to the aforementioned storage and transportation containers, an alternative method of transportation is a flowline distribution system, i.e., pipes between a central storage area, where a large supply of the cryogenic temperature fluid is being produced and/or stockpiled, and local distributors or users. All of these methods of transportation require use of storage containers and/or pipes constructed from a material that has adequate cryogenic temperature toughness to prevent failure and adequate strength to hold the high fluid pressures.

The Ductile to Brittle Transition Temperature (DBTT) delineates the two fracture regimes in structural steels. At temperatures below the DBTT, failure in the steel tends to occur by low energy cleavage (brittle) fracture, while at temperatures above the DBTT, failure in the steel tends to occur by high energy ductile fracture. Welded steels used in the construction of process components and containers for the aforementioned cryogenic temperature applications and for other load-bearing, cryogenic temperature service must have DBTTs well below the service temperature in both the base steel and the HAZ to avoid failure by low energy cleavage fracture.

Nickel-containing steels conventionally used for cryogenic temperature structural applications, e.g., steels with nickel contents of greater than about 3 wt %, have low DBTTs, but also have relatively low tensile strengths. Typically, commercially available 3.5 wt % Ni, 5.5 wt % Ni, and 9 wt % Ni steels have DBTTs of about −100° C. (−150° F.), −155° C. (−250° F.), and −175° C. (−280° F.), respectively, and tensile strengths of up to about 485 MPa (70 ksi), 620 MPa (90 ksi), and 830 MPa (120 ksi), respectively. In order to achieve these combinations of strength and toughness, these steels generally undergo costly processing, e.g., double annealing treatment. In the case of cryogenic temperature applications, industry currently uses these commercial nickel-containing steels because of their good toughness at low temperatures, but must design around their relatively low tensile strengths. The designs generally require excessive steel thicknesses for load-bearing, cryogenic temperature applications. Thus, use of these nickel-containing steels in load-bearing, cryogenic temperature applications tends to be expensive due to the high cost of the steel combined with the steel thicknesses required.

Although some commercially available carbon steels have DBTTs as low as about −46° C. (−50° F.), carbon steels that are commonly used in construction of commercially available process components and containers for hydrocarbon and chemical processes do not have adequate toughness for use in cryogenic temperature conditions. Materials with better cryogenic temperature toughness than carbon steel, e.g., the above-mentioned commercial nickel-containing steels (3 ½ wt % Ni to 9 wt % Ni), aluminum (Al-5083 or Al-5085), or stainless steel are traditionally used to construct commercially available process components and containers that are subject to cryogenic temperature conditions. Also, specialty materials such as titanium alloys and special epoxy-impregnated woven fiberglass composites are sometimes used. However, process components, containers, and/or pipes constructed from these materials often have increased wall thicknesses to provide the required strength. This adds weight to the components and containers which must be supported and/or transported, often at significant added cost to a project. Additionally, these materials tend to be more expensive than standard carbon steels. The added cost for support and transport of the thick-walled components and containers combined with the increased cost of the material for construction tends to decrease the economic attractiveness of projects.

A need exists for process components and containers suitable for economically containing and transporting cryogenic temperature fluids. A need also exists for pipes suitable for economically containing and transporting cryogenic temperature fluids.

Consequently, the primary object of the present invention is to provide process components and containers suitable for economically containing and transporting cryogenic temperature fluids and to provide pipes suitable for economically containing and transporting cryogenic temperature fluids. Another object of the present invention is to provide such process components, containers, and pipes that are constructed from materials having both adequate strength and fracture toughness to contain pressurized cryogenic temperature fluids.

SUMMARY OF THE INVENTION

Consistent with the above-stated objects of the present invention, process components, containers, and pipes are provided for containing and transporting cryogenic temperature fluids. The process components, containers, and pipes of this invention are constructed from materials comprising an ultra-high strength, low alloy steel containing less than 9 wt % nickel, preferably containing less than about 7 wt % nickel, more preferably containing less than about 5 wt % nickel, and even more preferably containing less than about 3 wt % nickel. The steel has an ultra-high strength, e.g., tensile strength (as defined herein) greater than 830 MPa (120 ksi), and a DBTT (as defined herein) lower than about −73° C. (−100° F.).

These new process components and containers can be advantageously used, for example, in cryogenic expander plants for natural gas liquids recovery, in liquefied natural gas ("LNG") treating and liquefaction processes, in the controlled freeze zone ("CFZ") process pioneered by Exxon Production Research Company, in cryogenic refrigeration systems, in low temperature power generation systems, and in cryogenic processes related to the manufacture of ethylene and propylene. Use of these new process components, containers, and pipes advantageously reduces the risk of cold brittle fracture normally associated with conventional carbon steels in cryogenic temperature service. Additionally, these process components and containers can increase the economic attractiveness of a project.

DESCRIPTION OF THE DRAWINGS

The advantages of the present invention will be better understood by referring to the following detailed description and the attached drawings in which.

Figure 1:
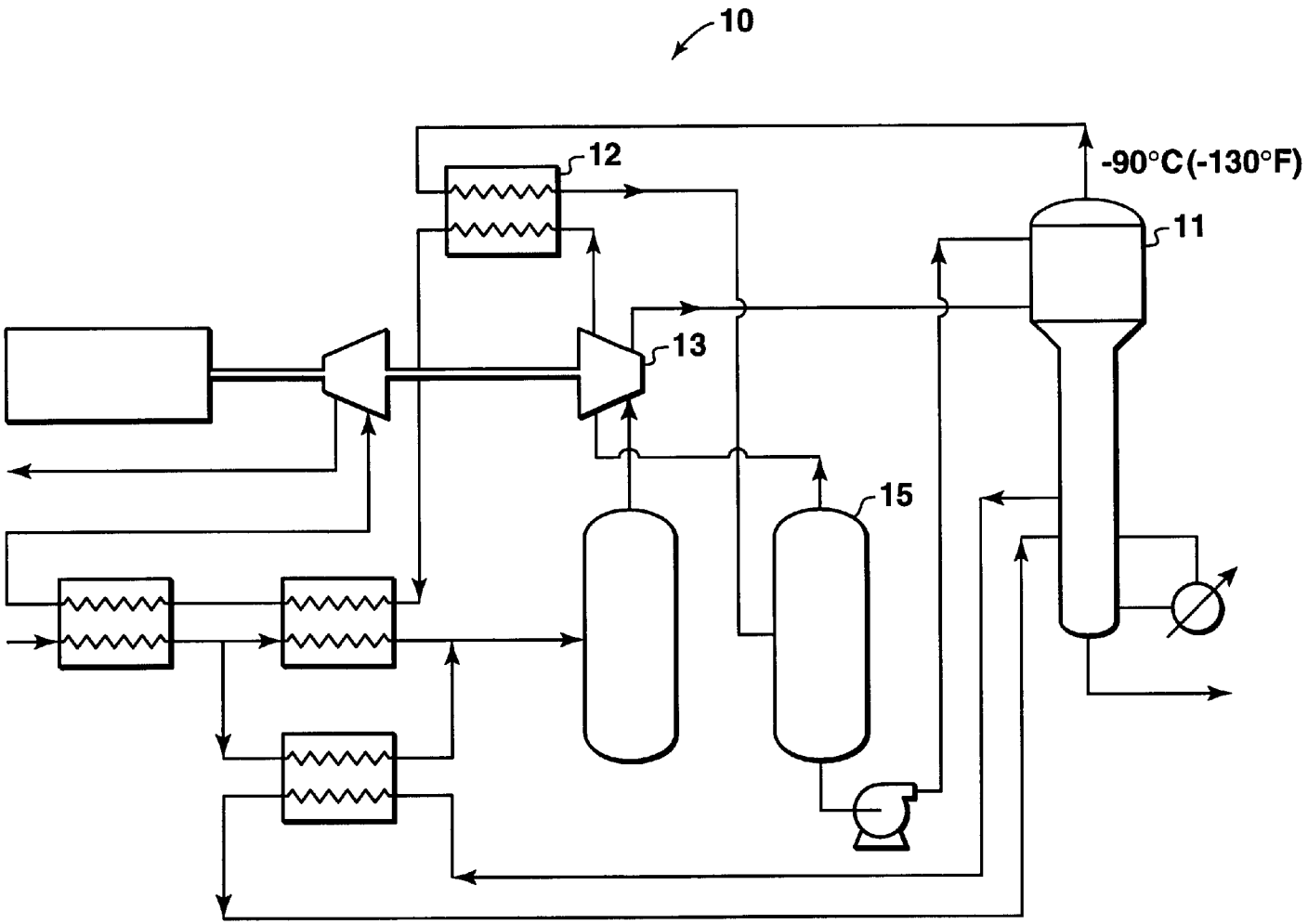
FIG. 1 is a typical process flow diagram illustrating how some of the process components of the present invention are used in a demethanizer gas plant.

While the invention will be described in connection with its preferred embodiments, it will be understood that the invention is not limited thereto. On the contrary, the invention is intended to cover all alternatives, modifications, and equivalents which may be included within the spirit and scope of the invention, as defined by the appended claims.

DETAILED DESCRIPTION OF THE INVENTION

The present invention relates to new process components, containers, and pipes suitable for processing, containing and transporting cryogenic temperature fluids; and, furthermore, to process components, containers, and pipes that are constructed from materials comprising an ultra-high strength, low alloy steel containing less than 9 wt % nickel and having a tensile strength greater than 830 MPa (120 ksi) and a DBTT lower than about −73° C. (−100° F.). Preferably, the ultra-high strength, low alloy steel has excellent cryogenic temperature toughness in both the base plate and in the heat affected zone (HAZ) when welded.

Process components, containers, and pipes suitable for processing and containing cryogenic temperature fluids are provided, wherein the process components, containers, and pipes are constructed from materials comprising an ultra-high strength, low alloy steel containing less than 9 wt % nickel and having a tensile strength greater than 830 MPa (120 ksi) and a DBTT lower than about −73° C. (−100° F.). Preferably the ultra-high strength, low alloy steel contains less than about 7 wt % nickel, and more preferably contains less than about 5 wt % nickel. Preferably the ultra-high strength, low alloy steel has a tensile strength greater than about 860 MPa (125 ksi), and more preferably greater than about 900 MPa (130 ksi). Even more preferably, the process components, containers, and pipes of this invention are constructed from materials comprising an ultra-high strength, low alloy steel containing less than about 3 wt % nickel and having a tensile strength exceeding about 1000 MPa (145 ksi) and a DBTT lower than about −73° C. (−100° F.).

A co-pending U.S. patent application ("the PLNG Patent Application"), entitled "Improved System for Processing, Storing, and Transporting Liquefied Natural Gas", describes containers and tanker ships for storage and marine transportation of pressurized liquefied natural gas (PLNG) at a pressure in the broad range of about 1035 kPa (150 psia) to about 7590 kPa (1100 psia) and at a temperature in the broad range of about −123° C. (−190° F.) to about −62° C. (−80° F.). The PLNG Patent Application has a priority date of Jun. 20, 1997 and is identified by the United States Patent and Trademark Office ("USPTO") as Application No. 09/099,268 and has been published in WO 98/59085. Additionally, the PLNG Patent Application describes systems and containers for processing, storing, and transporting PLNG. Preferably, the PLNG fuel is stored at a pressure of about 1725 kPa (250 psia) to about 7590 kPa (1100 psia) and at a temperature of about −112° C. (−170° F.) to about −62° C. (−80° F.). More preferably, the PLNG fuel is stored at a pressure in the range of about 2415 kPa (350 psia) to about 4830 kPa (700 psia) and at a temperature in the range of about −101° C. (−150° F.) to about −79° C. (−110° F.). Even more preferably, the lower ends of the pressure and temperature ranges for the PLNG fuel are about 2760 kPa (400 psia) and about −96° C. (−140° F.). Without hereby limiting this invention, the process components, containers, and pipes of this invention are preferably used for processing PLNG.

Steel for Construction of Process Components, Containers, and Pipes

Any ultra-high strength, low alloy steel containing less than 9 wt % nickel and having adequate toughness for containing cryogenic temperature fluids, such as PLNG, at operating conditions, according to known principles of fracture mechanics as described herein, may be used for constructing the process components, containers, and pipes of this invention. An example steel for use in the present invention, without thereby limiting the invention, is a weldable, ultra-high strength, low alloy steel containing less than 9 wt % nickel and having a tensile strength greater than 830 MPa (120 ksi) and adequate toughness to prevent initiation of a fracture, i.e., a failure event, at cryogenic temperature operating conditions. Another example steel for use in the present invention, without thereby limiting the invention, is a weldable, ultra-high strength, low alloy steel containing less than about 3 wt % nickel and having a tensile strength of at least about 1000 MPa (145 ksi) and adequate toughness to prevent initiation of a fracture, i.e., a failure event, at cryogenic temperature operating conditions. Preferably these example steels have DBTTs of lower than about −73° C. (−100° F.).

Recent advances in steel making technology have made possible the manufacture of new, ultra-high strength, low alloy steels with excellent cryogenic temperature toughness. For example, three U.S. patents issued to Koo et al., U.S. Pat. Nos. 5,531,842, 5,545,269, and 5,545,270, describe new steels and methods for processing these steels to produce steel plates with tensile strengths of about 830 MPa (120 ksi), 965 MPa (140 ksi), and higher. The steels and processing methods described therein have been improved and modified to provide combined steel chemistries and processing for manufacturing ultra-high strength, low alloy steels with excellent cryogenic temperature toughness in both the base steel and in the heat affected zone (HAZ) when welded. These ultra-high strength, low alloy steels also have improved toughness over standard commercially available ultra-high strength, low alloy steels. The improved steels are described in a co-pending U.S. patent application entitled "ULTRA-HIGH STRENGTH STEELS WITH EXCELLENT CRYOGENIC TEMPERATURE TOUGHNESS", which has a priority date of Dec. 19, 1997 and is identified by the United States Patent and Trademark Office ("USPTO") as Application No. 09/099,649 and has been published in WO 99/32672; in a co-pending U.S. patent application entitled "ULTRA-HIGH STRENGTH AUSAGED STEELS WITH EXCELLENT CRYOGENIC TEMPERATURE TOUGHNESS", which has a priority date of Dec. 19, 1997 and is identified by the USPTO as Application No. 09/099,153 and has been published in WO 99/32670; and in a co-pending U.S. patent application entitled "ULTRA-HIGH STRENGTH DUAL PHASE STEELS WITH EXCELLENT CRYOGENIC TEMPERATURE TOUGHNESS", which has a priority date of Dec. 19, 1997 and is identified by the USPTO as Application No. 09/099,152 and has been published in WO 99/32671. (collectively, the "Steel patent applications").

The new steels described in the Steel patent applications, and further described in the examples below, are especially suitable for constructing the process components, containers, and pipes of this invention in that the steels have the following characteristics, preferably for steel plate thicknesses of about 2.5 cm (1 inch) and greater: (i) DBTT lower than about −73° C. (−100° F.), preferably lower than about −107° C. (−160° F.), in the base steel and in the weld HAZ; (ii) tensile strength greater than 830 MPa (120 ksi), preferably greater than about 860 MPa (125 ksi), and more preferably greater than about 900 MPa (130 ksi); (iii) superior weldability; (iv) substantially uniform through-thickness microstructure and properties; and (v) improved toughness over standard, commercially available, ultra-high strength, low alloy steels. Even more preferably, these steels have a tensile strength of greater than about 930 MPa (135 ksi), or greater than about 965 MPa (140 ksi), or greater than about 1000 MPa (145 ksi).

First Steel Example

As discussed above, a copending U.S. patent application, having a priority date of Dec. 19, 1997, entitled "Ultra-High Strength Steels With Excellent Cryogenic Temperature Toughness", and identified by the USPTO as Application No. 09/099,649 and has been published in WO 99/32672, provides a description of steels suitable for use in the present invention. A method is provided for preparing an ultra-high strength steel plate having a microstructure comprising predominantly tempered fine-grained lath martensite, tempered fine-grained lower bainite, or mixtures thereof, wherein the method comprises the steps of (a) heating a steel slab to a reheating temperature sufficiently high to (i) substantially homogenize the steel slab, (ii) dissolve substantially all carbides and carbonitrides of niobium and vanadium in the steel slab, and (iii) establish fine initial austenite grains in the steel slab; (b) reducing the steel slab to form steel plate in one or more hot rolling passes in a first temperature range in which austenite recrystallizes; (c) further reducing the steel plate in one or more hot rolling passes in a second temperature range below about the $T_{nr}$ temperature and above about the $Ar_3$ transformation temperature; (d) quenching the steel plate at a cooling rate of about 10° C. per second to about 40° C. per second (18° F./sec −72° F./sec) to a Quench Stop Temperature below about the $M_s$ transformation temperature plus 200° C. (360° F.); (e) stopping the quenching; and (f) tempering the steel plate at a tempering temperature from about 400° C. (752° F.) up to about the $Ac_1$ transformation temperature, preferably up to, but not including, the $Ac_1$ transformation temperature, for a period of time sufficient to cause precipitation of hardening particles, i.e., one or more of ϵ-copper, $Mo_2C$, or the carbides and carbonitrides of niobium and vanadium. The period of time sufficient to cause precipitation of hardening particles depends primarily on the thickness of the steel plate, the chemistry of the steel plate, and the tempering temperature, and can be determined by one skilled in the art. (See Glossary for definitions of predominantly, of hardening particles, of $T_{nr}$ temperature, of $Ar_3$, $M_s$, and $Ac_1$ transformation temperatures, and of $Mo_2C$).

To ensure ambient and cryogenic temperature toughness, steels according to this first steel example preferably have a microstructure comprised of predominantly tempered fine-grained lower bainite, tempered fine-grained lath martensite, or mixtures thereof. It is preferable to substantially minimize the formation of embrittling constituents such as upper bainite, twinned martensite and MA. As used in this first steel example, and in the claims, "predominantly" means at least about 50 volume percent. More preferably, the microstructure comprises at least about 60 volume percent to about 80 volume percent tempered fine-grained lower bainite, tempered fine-grained lath martensite, or mixtures thereof. Even more preferably, the microstructure comprises at least about 90 volume percent tempered fine-grained lower bainite, tempered fine-grained lath martensite, or mixtures thereof. Most preferably, the microstructure comprises substantially 100% tempered fine-grained lath martensite.

A steel slab processed according to this first steel example is manufactured in a customary fashion and, in one embodiment, comprises iron and the following alloying elements, preferably in the weight ranges indicated in the following Table I:

TABLE I

| Alloying Element | Range (wt %) |
|---|---|
| carbon (C) | 0.04–0.12, more preferably 0.04–0.07 |
| manganese (Mn) | 0.5–2.5, more preferably 1.0 1.8 |
| nickel (Ni) | 1.0–3.0, more preferably 1.5–2.5 |
| copper (Cu) | 0.1–1.5, more preferably 0.5–1.0 |
| molybdenum (Mo) | 0.1–0.8, more preferably 0.2–0.5 |
| niobium (Nb) | 0.02–0.1, more preferably 0.03–0.05 |
| titanium (Ti) | 0.008–0.03, more preferably 0.01–0.02 |
| aluminum (Al) | 0.001–0.05, more preferably 0.005–0.03 |
| nitrogen (N) | 0.002–0.005, more preferably 0.002–0.003 |

Vanadium (V) is sometimes added to the steel, preferably up to about 0.10 wt %, and more preferably about 0.02 wt % to about 0.05 wt %.

Chromium (Cr) is sometimes added to the steel, preferably up to about 1.0 wt %, and more preferably about 0.2 wt % to about 0.6 wt %.

Silicon (Si) is sometimes added to the steel, preferably up to about 0.5 wt %, more preferably about 0.01 wt % to about 0.5 wt %, and even more preferably about 0.05 wt % to about 0.1 wt %.

Boron (B) is sometimes added to the steel, preferably up to about 0.0020 wt %, and more preferably about 0.0006 wt % to about 0.0010 wt %.

The steel preferably contains at least about 1 wt % nickel. Nickel content of the steel can be increased above about 3 wt % if desired to enhance performance after welding. Each 1 wt % addition of nickel is expected to lower the DBTT of the steel by about 10° C. (18° F.). Nickel content is preferably less than 9 wt %, more preferably less than about 6 wt %. Nickel content is preferably minimized in order to minimize cost of the steel. If nickel content is increased above about 3 wt %, manganese content can be decreased below about 0.5 wt % down to 0.0 wt %. Therefore, in a broad sense, up to about 2.5 wt % manganese is preferred.

Additionally, residuals are preferably substantially minimized in the steel. Phosphorous (P) content is preferably less than about 0.01 wt %. Sulfur (S) content is preferably less than about 0.004 wt %. Oxygen (O) content is preferably less than about 0.002 wt %.

In somewhat greater detail, a steel according to this first steel example is prepared by forming a slab of the desired composition as described herein; heating the slab to a temperature of from about 955° C. to about 1065° C. (1750° F.–1950° F.); hot rolling the slab to form steel plate in one or more passes providing about 30 percent to about 70 percent reduction in a first temperature range in which austenite recrystallizes, i.e., above about the $T_{nr}$ temperature, and further hot rolling the steel plate in one or more passes providing about 40 percent to about 80 percent reduction in a second temperature range below about the $T_{nr}$ temperature and above about the $Ar_3$ transformation temperature. The hot rolled steel plate is then quenched at a cooling rate of about 10° C. per second to about 40° C. per second (18° F./sec–72° F./sec) to a suitable QST (as defined in the Glossary) below about the $M_s$ transformation temperature plus 200° C. (360° F.), at which time the quenching is terminated. In one embodiment of this first steel example, the steel plate is then air cooled to ambient temperature. This processing is used to produce a microstructure preferably comprising predominantly fine-grained lath martensite, fine-grained lower bainite, or mixtures thereof, or, more preferably comprising substantially 100% fine-grained lath martensite.

The thus direct quenched martensite in steels according to this first steel example has ultra-high strength but its toughness can be improved by tempering at a suitable temperature from above about 400° C. (752° F.) up to about the $Ac_1$ transformation temperature. Tempering of steel within this temperature range also leads to reduction of the quenching stresses which in turn leads to enhanced toughness. While tempering can enhance the toughness of the steel, it normally leads to substantial loss of strength. In the present invention, the usual strength loss from tempering is offset by inducing precipitate dispersion hardening. Dispersion hardening from fine copper precipitates and mixed carbides and/or carbonitrides are utilized to optimize strength and toughness during the tempering of the martensitic structure. The unique chemistry of the steels of this first steel example allows for tempering within the broad range of about 400° C. to about 650° C. (750° F.–1200° F.) without any significant loss of the as-quenched strength. The steel plate is preferably tempered at a tempering temperature from above about 400° C. (752° F.) to below the $Ac_1$ transformation temperature for a period of time sufficient to cause precipitation of hardening particles (as defined herein). This processing facilitates transformation of the microstructure of the steel plate to predominantly tempered fine-grained lath martensite, tempered fine-grained lower bainite, or mixtures thereof. Again, the period of time sufficient to cause precipitation of hardening particles depends primarily on the thickness of the steel plate, the chemistry of the steel plate, and the tempering temperature, and can be determined by one skilled in the art.

Second Steel Example

As discussed above, a copending U.S. patent application, having a priority date of Dec. 19, 1997, entitled "Ultra-High Strength Ausaged Steels With Excellent Cryogenic Temperature Toughness", and identified by the USPTO as Application No. 09/099,153 and has been published in WO 99/32670, provides a description of other steels suitable for use in the present invention. A method is provided for preparing an ultra-high strength steel plate having a micro-laminate microstructure comprising about 2 vol % to about 10 vol % austenite film layers and about 90 vol % to about 98 vol % laths of predominantly fine-grained martensite and fine-grained lower bainite, said method comprising the steps of: (a) heating a steel slab to a reheating temperature sufficiently high to (i) substantially homogenize the steel slab, (ii) dissolve substantially all carbides and carbonitrides of niobium and vanadium in the steel slab, and (iii) establish fine initial austenite grains in the steel slab; (b) reducing the steel slab to form steel plate in one or more hot rolling passes in a first temperature range in which austenite recrystallizes; (c) further reducing the steel plate in one or more hot rolling passes in a second temperature range below about the $T_{nr}$ temperature and above about the $Ar_3$ transformation temperature; (d) quenching the steel plate at a cooling rate of about 10° C. per second to about 40° C. per second (18° F./sec–72° F./sec) to a Quench Stop Temperature (QST) below about the $M_s$ transformation temperature plus 100° C. (180° F.) and above about the $M_s$ transformation temperature; and (e) stopping said quenching. In one embodiment, the method of this second steel example further comprises the step of allowing the steel plate to air cool to ambient temperature from the QST. In another embodiment, the method of this second steel example further comprises the step of holding the steel plate substantially isothermally at the QST for up to about 5 minutes prior to allowing the steel plate to air cool to ambient temperature. In yet another embodiment, the method of this second steel example further comprises the step of slow-cooling the steel plate from the QST at a rate lower than about 1.0° C. per second (1.8° F./sec) for up to about 5 minutes prior to allowing the steel plate to air cool to ambient temperature. In yet another embodiment, the method of this invention further comprises the step of slow-cooling the steel plate from the QST at a rate lower than about 1.0° C. per second (1.8° F./sec) for up to about 5 minutes prior to allowing the steel plate to air cool to ambient temperature. This processing facilitates transformation of the microstructure of the steel plate to about 2 vol % to about 10 vol % of austenite film layers and about 90 vol % to about 98 vol % laths of predominantly fine-grained martensite and fine-grained lower bainite. (See Glossary for definitions of $T_{nr}$ temperature, and of $Ar_3$ and $M_s$ transformation temperatures.)

To ensure ambient and cryogenic temperature toughness, the laths in the micro-laminate microstructure preferably comprise predominantly lower bainite or martensite. It is preferable to substantially minimize the formation of embrittling constituents such as upper bainite, twinned martensite and MA. As used in this second steel example, and in the claims, "predominantly" means at least about 50 volume percent. The remainder of the microstructure can comprise additional fine-grained lower bainite, additional fine-grained lath martensite, or ferrite. More preferably, the microstructure comprises at least about 60 volume percent to about 80 volume percent lower bainite or lath martensite. Even more preferably, the microstructure comprises at least about 90 volume percent lower bainite or lath martensite.

A steel slab processed according to this second steel example is manufactured in a customary fashion and, in one embodiment, comprises iron and the following alloying elements, preferably in the weight ranges indicated in the following Table II:

TABLE II

| Alloying Element | Range (wt %) |
|---|---|
| carbon (C) | 0.04–0.12, more preferably 0.04–0.07 |
| manganese (Mn) | 0.5–2.5, more preferably 1.0–1.8 |
| nickel (Ni) | 1.0–3.0, more preferably 1.5–2.5 |
| copper (Cu) | 0.1–1.0, more preferably 0.2–0.5 |
| molybdenum (Mo) | 0.1–0.8, more preferably 0.2–0.4 |
| niobium (Nb) | 0.02–0.1, more preferably 0.02–0.05 |
| titanium (Ti) | 0.008–0.03, more preferably 0.01–0.02 |
| Aluminum (Al) | 0.001–0.05, more preferably 0.005–0.03 |
| nitrogen (N) | 0.002–0.005, more preferably 0.002–0.003 |

Chromium (Cr) is sometimes added to the steel, preferably up to about 1.0 wt %, and more preferably about 0.2 wt % to about 0.6 wt %.

Silicon (Si) is sometimes added to the steel, preferably up to about 0.5 wt %, more preferably about 0.01 wt % to about 0.5 wt %, and even more preferably about 0.05 wt % to about 0.1 wt %.

Boron (B) is sometimes added to the steel, preferably up to about 0.0020 wt %, and more preferably about 0.0006 wt % to about 0.0010 wt %.

The steel preferably contains at least about 1 wt % nickel. Nickel content of the steel can be increased above about 3 wt % if desired to enhance performance after welding. Each 1 wt % addition of nickel is expected to lower the DBTT of the steel by about 10° C. (18° F.). Nickel content is preferably less than 9 wt %, more preferably less than about 6 wt %. Nickel content is preferably minimized in order to minimize cost of the steel. If nickel content is increased above about 3 wt %, manganese content can be decreased below about 0.5 wt % down to 0.0 wt %. Therefore, in a broad sense, up to about 2.5 wt % manganese is preferred.

Additionally, residuals are preferably substantially minimized in the steel. Phosphorous (P) content is preferably less than about 0.01 wt %. Sulfur (S) content is preferably less than about 0.004 wt %. Oxygen (O) content is preferably less than about 0.002 wt %.

In somewhat greater detail, a steel according to this second steel example is prepared by forming a slab of the desired composition as described herein; heating the slab to a temperature of from about 955° C. to about 1065° C. (1750° F.–1950° F.); hot rolling the slab to form steel plate in one or more passes providing about 30 percent to about 70 percent reduction in a first temperature range in which austenite recrystallizes, i.e., above about the $T_{nr}$ temperature, and further hot rolling the steel plate in one or more passes providing about 40 percent to about 80 percent reduction in a second temperature range below about the $T_{nr}$ temperature and above about the $Ar_3$ transformation temperature. The hot rolled steel plate is then quenched at a cooling rate of about 10° C. per second to about 40° C. per second (18° F./sec–72° F./sec) to a suitable QST below about the $M_s$ transformation temperature plus 100° C. (180° F.) and above about the $M_s$ transformation temperature, at which time the quenching is terminated. In one embodiment of this second steel example, after quenching is terminated the steel plate is allowed to air cool to ambient temperature from the QST. In another embodiment of this second steel example, after quenching is terminated the steel plate is held substantially isothermally at the QST for a period of time, preferably up to about 5 minutes, and then air cooled to ambient temperature. In yet another embodiment, the steel plate is slow-cooled at a rate slower than that of air cooling, i.e., at a rate lower than about 1° C. per second (1.8° F./sec), preferably for up to about 5 minutes. In yet another embodiment, the steel plate is slow-cooled from the QST at a rate slower than that of air cooling, i.e., at a rate lower than about 1° C. per second (1.8° F./sec), preferably for up to about 5 minutes. In at least one embodiment of this second steel example, the $M_s$ transformation temperature is about 350° C. (662° F.) and, therefore, the $M_s$ transformation temperature plus 100° C. (180° F.) is about 450° C. (842° F.).

The steel plate may be held substantially isothermally at the QST by any suitable means, as are known to those skilled in the art, such as by placing a thermal blanket over the steel plate. The steel plate may be slow-cooled after quenching is terminated by any suitable means, as are known to those skilled in the art, such as by placing an insulating blanket over the steel plate.

Third Steel Example

As discussed above, a copending U.S. patent application, having a priority date of Dec. 19, 1997, entitled "Ultra-High Strength Dual Phase Steels With Excellent Cryogenic Temperature Toughness", and identified by the USPTO as Application No. 09/099,152 and has been published in WO 99/32671, provides a description of other steels suitable for use in the present invention. A method is provided for preparing an ultra-high strength, dual phase steel plate having a microstructure comprising about 10 vol % to about 40 vol % of a first phase of substantially 100 vol % (i.e., substantially pure or "essentially") ferrite and about 60 vol % to about 90 vol % of a second phase of predominantly fine-grained lath martensite, fine-grained lower bainite, or mixtures thereof, wherein the method comprises the steps of (a) heating a steel slab to a reheating temperature sufficiently high to (i) substantially homogenize the steel slab, (ii) dissolve substantially all carbides and carbonitrides of niobium and vanadium in the steel slab, and (iii) establish fine initial austenite grains in the steel slab; (b) reducing the steel slab to form steel plate in one or more hot rolling passes in a first temperature range in which austenite recrystallizes; (c) further reducing the steel plate in one or more hot rolling passes in a second temperature range below about the $T_{nr}$ temperature and above about the $Ar_3$ transformation temperature; (d) further reducing said steel plate in one or more hot rolling passes in a third temperature range below about the $Ar_3$ transformation temperature and above about the $Ar_1$ transformation temperature (i.e., the intercritical temperature range); (e) quenching said steel plate at a cooling rate of about 10° C. per second to about 40° C. per second (18° F./sec–72° F./sec) to a Quench Stop Temperature (QST) preferably below about the $M_s$ transformation temperature plus 200° C. (360° F.); and (f) stopping said quenching. In another embodiment of this third steel example, the QST is preferably below about the $M_s$ transformation temperature plus 100° C. (180° F.), and is more preferably below about 350° C. (662° F.). In one embodiment of this third steel example, the steel plate is allowed to air cool to ambient temperature after step (f). This processing facilitates transformation of the microstructure of the steel plate to about 10 vol % to about 40 vol % of a first phase of ferrite and about 60 vol % to about 90 vol % of a second phase of predominantly fine-grained lath martensite, fine-grained lower bainite, or mixtures thereof. (See Glossary for definitions of $T_{nr}$ temperature, and of $Ar_3$ and $Ar_1$ transformation temperatures).

To ensure ambient and cryogenic temperature toughness, the microstructure of the second phase in steels of this third steel example comprises predominantly fine-grained lower bainite, fine-grained lath martensite, or mixtures thereof. It is preferable to substantially minimize the formation of embrittling constituents such as upper bainite, twinned martensite and MA in the second phase. As used in this third steel example, and in the claims, "predominantly" means at least about 50 volume percent. The remainder of the second phase microstructure can comprise additional fine-grained lower bainite, additional fine-grained lath martensite, or ferrite. More preferably, the microstructure of the second phase comprises at least about 60 volume percent to about 80 volume percent fine-grained lower bainite, fine-grained lath martensite, or mixtures thereof. Even more preferably, the microstructure of the second phase comprises at least about 90 volume percent fine-grained lower bainite, fine-grained lath martensite, or mixtures thereof.

A steel slab processed according to this third steel example is manufactured in a customary fashion and, in one embodiment, comprises iron and the following alloying elements, preferably in the weight ranges indicated in the following Table III:

TABLE III

| Alloying Element | Range (wt %) |
|---|---|
| carbon (C) | 0.04–0.12, more preferably 0.04–0.07 |
| manganese (Mn) | 0.5–2.5, more preferably 1.0–1.8 |
| nickel (Ni) | 1.0–3.0, more preferably 1.5–2.5 |
| niobium (Nb) | 0.02–0.1, more preferably 0.02–0.05 |
| titanium (Ti) | 0.008–0.03, more preferably 0.01–0.02 |
| aluminum (Al) | 0.001–0.05, more preferably 0.005–0.03 |
| nitrogen (N) | 0.002–0.005, more preferably 0.002–0.003 |

Chromium (Cr) is sometimes added to the steel, preferably up to about 1.0 wt %, and more preferably about 0.2 wt % to about 0.6 wt %.

Molybdenum (Mo) is sometimes added to the steel, preferably up to about 0.8 wt %, and more preferably about 0.1 wt % to about 0.3 wt %.

Silicon (Si) is sometimes added to the steel, preferably up to about 0.5 wt %, more preferably about 0.01 wt % to about 0.5 wt %, and even more preferably about 0.05 wt % to about 0.1 wt %.

Copper (Cu), preferably in the range of about 0.1 wt % to about 1.0 wt %, more preferably in the range of about 0.2 wt % to about 0.4 wt %, is sometimes added to the steel.

Boron (B) is sometimes added to the steel, preferably up to about 0.0020 wt %, and more preferably about 0.0006 wt % to about 0.0010 wt %.

The steel preferably contains at least about 1 wt % nickel. Nickel content of the steel can be increased above about 3 wt % if desired to enhance performance after welding. Each 1 wt % addition of nickel is expected to lower the DBTT of the steel by about 10° C. (18° F.). Nickel content is preferably less than 9 wt %, more preferably less than about 6 wt %. Nickel content is preferably minimized in order to minimize cost of the steel. If nickel content is increased above about 3 wt %, manganese content can be decreased below about 0.5 wt % down to 0.0 wt %. Therefore, in a broad sense, up to about 2.5 wt % manganese is preferred.

Additionally, residuals are preferably substantially minimized in the steel. Phosphorous (P) content is preferably less than about 0.01 wt %. Sulfur (S) content is preferably less than about 0.004 wt %. Oxygen (O) content is preferably less than about 0.002 wt %.

In somewhat greater detail, a steel according to this third steel example is prepared by forming a slab of the desired composition as described herein; heating the slab to a temperature of from about 955° C. to about 1065° C. (1750° F.–1950° F.); hot rolling the slab to form steel plate in one or more passes providing about 30 percent to about 70 percent reduction in a first temperature range in which austenite recrystallizes, i.e., above about the $T_{nr}$ temperature, further hot rolling the steel plate in one or more passes providing about 40 percent to about 80 percent reduction in a second temperature range below about the $T_{nr}$ temperature and above about the $Ar_3$ transformation temperature, and finish rolling the steel plate in one or more passes to provide about 15 percent to about 50 percent reduction in the intercritical temperature range below about the $Ar_3$ transformation temperature and above about the $Ar_1$ transformation temperature. The hot rolled steel plate is then quenched at a cooling rate of about 10° C. per second to about 40° C. per second (18° F./sec–72° F./sec) to a suitable Quench Stop Temperature (QST) preferably below about the $M_s$ transformation temperature plus 200° C. (360° F.), at which time the quenching is terminated. In another embodiment of this invention, the QST is preferably below about the $M_s$ transformation temperature plus 100° C. (180° F.), and is more preferably below about 350° C. (662° F.). In one embodiment of this third steel example, the steel plate is allowed to air cool to ambient temperature after quenching is terminated.

In the three example steels above, since Ni is an expensive alloying element, the Ni content of the steel is preferably less than about 3.0 wt %, more preferably less than about 2.5 wt %, more preferably less than about 2.0 wt %, and even more preferably less than about 1.8 wt %, to substantially minimize cost of the steel.

Other suitable steels for use in connection with the present invention are described in other publications that describe ultra-high strength, low alloy steels containing less than about 1 wt % nickel, having tensile strengths greater than 830 MPa (120 ksi), and having excellent low-temperature toughness. For example, such steels are described in a European Patent Application published Feb. 5, 1997, and having International application number: PCT/JP96/00157, and International publication number WO 96/23909 (08.08.1996 Gazette 1996/36) (such steels preferably having a copper content of 0.1 wt % to 1.2 wt %), and in a pending U.S. patent application with a priority date of Jul. 28, 1997, entitled "Ultra-High Strength, Weldable Steels with Excellent Ultra-Low Temperature Toughness", and identified by the USPTO as Application No. 09/123,625 and has been published in WO 99/05335.

For any of the above-referenced steels, as is understood by those skilled in the art, as used herein "percent reduction in thickness" refers to percent reduction in the thickness of the steel slab or plate prior to the reduction referenced. For purposes of explanation only, without thereby limiting this invention, a steel slab of about 25.4 cm (10 inches) thickness may be reduced about 50% (a 50 percent reduction), in a first temperature range, to a thickness of about 12.7 cm (5 inches) then reduced about 80% (an 80 percent reduction), in a second temperature range, to a thickness of about 2.5 cm (1 inch). Again, for purposes of explanation only, without thereby limiting this invention, a steel slab of about 25.4 cm (10 inches) may be reduced about 30% (a 30 percent reduction), in a first temperature range, to a thickness of about 17.8 cm (7 inches) then reduced about 80% (an 80 percent reduction), in a second temperature range, to a thickness of about 3.6 cm (1.4 inch), and then reduced about 30% (a 30 percent reduction), in a third temperature range, to a thickness of about 2.5 cm (1 inch). As used herein, "slab" means a piece of steel having any dimensions.

For any of the above-referenced steels, as is understood by those skilled in the art, the steel slab is preferably reheated by a suitable means for raising the temperature of substantially the entire slab, preferably the entire slab, to the desired reheating temperature, e.g., by placing the slab in a furnace for a period of time. The specific reheating temperature that should be used for any of the above-referenced steel compositions may be readily determined by a person skilled in the art, either by experiment or by calculation using suitable models. Additionally, the furnace temperature and reheating time necessary to raise the temperature of substantially the entire slab, preferably the entire slab, to the desired reheating temperature may be readily determined by a person skilled in the art by reference to standard industry publications.

For any of the above-referenced steels, as is understood by those skilled in the art, the temperature that defines the boundary between the recrystallization range and non-recrystallization range, the $T_{nr}$ temperature, depends on the chemistry of the steel, and more particularly, on the reheating temperature before rolling, the carbon concentration, the niobium concentration and the amount of reduction given in the rolling passes. Persons skilled in the art may determine this temperature for each steel composition either by experiment or by model calculation. Likewise, the $Ac_1$, $Ar_1$, $Ar_3$, and $M_s$ transformation temperatures referenced herein may be determined by persons skilled in the art for each steel composition either by experiment or by model calculation.

For any of the above-referenced steels, as is understood by those skilled in the art, except for the reheating temperature, which applies to substantially the entire slab, subsequent temperatures referenced in describing the processing methods of this invention are temperatures measured at the surface of the steel. The surface temperature of steel can be measured by use of an optical pyrometer, for example, or by any other device suitable for measuring the surface temperature of steel. The cooling rates referred to herein are those at the center, or substantially at the center, of the plate thickness; and the Quench Stop Temperature (QST) is the highest, or substantially the highest, temperature reached at the surface of the plate, after quenching is stopped, because of heat transmitted from the mid-thickness of the plate. For example, during processing of experimental heats of a steel composition according to this examples provided herein, a thermocouple is placed at the center, or substantially at the center, of the steel plate thickness for center temperature measurement, while the surface temperature is measured by use of an optical pyrometer. A correlation between center temperature and surface temperature is developed for use during subsequent processing of the same, or substantially the same, steel composition, such that center temperature may be determined via direct measurement of surface temperature. Also, the required temperature and flow rate of he quenching fluid to accomplish the desired accelerated cooling rate may be determined by one skilled in the art by reference to standard industry publications.

A person of skill in the art has the requisite knowledge and skill to use the information provided herein to produce ultra-high strength, low alloy steel plates having suitable high strength and toughness for use in constructing the process components, containers, and pipes of the present invention. Other suitable steels may exist or be developed hereafter. All such steels are within the scope of the present invention.

A person of skill in the art has the requisite knowledge and skill to use the information provided herein to produce ultra-high strength, low alloy steel plates having modified thicknesses, compared to the thicknesses of the steel plates produced according to the examples provided herein, while still producing steel plates having suitable high strength and suitable cryogenic temperature toughness for use in the present invention. For example, one skilled in the art may use the information provided herein to produce a steel plate with a thickness of about 2.54 cm (1 inch) and suitable high strength and suitable cryogenic temperature toughness for use in constructing the process components, containers, and pipes of the present invention. Other suitable steels may exist or be developed hereafter. All such steels are within the scope of the present invention.

When a dual phase steel is used in the construction of process components, containers, and pipes according to this invention, the dual phase steel is preferably processed in such a manner that the time period during which the steel is maintained in the intercritical temperature range for the purpose of creating the dual phase structure occurs before the accelerated cooling or quenching step. Preferably the processing is such that the dual phase structure is formed during cooling of the steel between the $Ar_3$ transformation temperature to about the $Ar_1$ transformation temperature. An additional preference for steels used in the construction of process components, containers, and pipes according to this invention is that the steel has a tensile strength greater than 830 MPa (120 ksi) and a DBTT lower than about −73° C. (−100° F.) upon completion of the accelerated cooling or quenching step, i.e., without any additional processing that requires reheating of the steel such as tempering. More preferably the tensile strength of the steel upon completion of the quenching or cooling step is greater than about 860 MPa (125 ksi), and more preferably greater than about 900 MPa (130 ksi). In some applications, a steel having a tensile strength of greater than about 930 MPa (135 ksi), or greater than about 965 MPa (140 ksi), or greater than about 1000 MPa (145 ksi), upon completion of the quenching or cooling step is preferable.

Joining Methods for Construction of Process Components, Containers, and Pipes

In order to construct the process components, containers, and pipes of the present invention, a suitable method of joining the steel plates is required. Any joining method that will provide joints or seams with adequate strength and toughness for the present invention, as discussed above, is considered to be suitable. Preferably, a welding method suitable for providing adequate strength and fracture toughness to contain the fluid being contained or transported is used to construct the process components, containers, and pipes of the present invention. Such a welding method preferably includes a suitable consumable wire, a suitable consumable gas, a suitable welding process, and a suitable welding procedure. For example, both gas metal arc welding (GMAW) and tungsten inert gas (TIG) welding, which are both well known in the steel fabrication industry, can be used to join the steel plates, provided that a suitable consumable wire-gas combination is used.

In a first example welding method, the gas metal arc welding (GMAW) process is used to produce a weld metal chemistry comprising iron and about 0.07 wt % carbon, about 2.05 wt % manganese, about 0.32 wt % silicon, about 2.20 wt % nickel, about 0.45 wt % chromium, about 0.56 wt % molybdenum, less than about 110 ppm phosphorous, and less than about 50 ppm sulfur. The weld is made on a steel, such as any of the above-described steels, using an argon-based shielding gas with less than about 1 wt % oxygen. The welding heat input is in the range of about 0.3 kJ/mm to about 1.5 kJ/mm (7.6 kJ/inch to 38 kJ/inch). Welding by this method provides a weldment (see Glossary) having a tensile strength greater than about 900 MPa (130 ksi), preferably greater than about 930 MPa (135 ksi), more preferably greater than about 965 MPa (140 ksi), and even more preferably at least about 1000 MPa (145 ksi). Further, welding by this method provides a weld metal with a DBTT below about −73° C. (−100° F.), preferably below about −96° C. (−140° F.), more preferably below about −106° C. (−160° F.), and even more preferably below about −115° C. (−175° F.).

In another example welding method, the GMAW process is used to produce a weld metal chemistry comprising iron and about 0.10 wt % carbon (preferably less than about 0.10 wt % carbon, more preferably from about 0.07 to about 0.08 wt % carbon), about 1.60 wt % manganese, about 0.25 wt % silicon, about 1.87 wt % nickel, about 0.87 wt % chromium, about 0.51 wt % molybdenum, less than about 75 ppm phosphorous, and less than about 100 ppm sulfur. The welding heat input is in the range of about 0.3 kJ/mm to about 1.5 kJ/mm (7.6 kJ/inch to 38 kJ/inch) and a preheat of about 100° C. (212° F.) is used. The weld is made on a steel, such as any of the above-described steels, using an argon-based shielding gas with less than about 1 wt % oxygen. Welding by this method provides a weldment having a tensile strength greater than about 900 MPa (130 ksi), preferably greater than about 930 MPa (135 ksi), more preferably greater than about 965 MPa (140 ksi), and even more preferably at least about 1000 MPa (145 ksi). Further, welding by this method provides a weld metal with a DBTT below about −73° C. (−100° F.), preferably below about −96° C. (−140° F.), more preferably below about −106° C. (−160° F.), and even more preferably below about −115° C. (−175° F.).

In another example welding method, the tungsten inert gas welding (TIG) process is used to produce a weld metal chemistry containing iron and about 0.07 wt % carbon (preferably less than about 0.07 wt % carbon), about 1.80 wt % manganese, about 0.20 wt % silicon, about 4.00 wt % nickel, about 0.5 wt % chromium, about 0.40 wt % molybdenum, about 0.02 wt % copper, about 0.02 wt % aluminum, about 0.010 wt % titanium, about 0.015 wt % zirconium (Zr), less than about 50 ppm phosphorous, and less than about 30 ppm sulfur. The welding heat input is in the range of about 0.3 kJ/mm to about 1.5 kJ/mm (7.6 kJ/inch to 38 kJ/inch) and a preheat of about 100° C. (212° F.) is used. The weld is made on a steel, such as any of the above-described steels, using an argon-based shielding gas with less than about 1 wt % oxygen. Welding by this method provides a weldment having a tensile strength greater than about 900 MPa (130 ksi), preferably greater than about 930 MPa (135 ksi), more preferably greater than about 965 MPa (140 ksi), and even more preferably at least about 1000 MPa (145 ksi). Further, welding by this method provides a weld metal with a DBTT below about −73° C. (−100° F.), preferably below about −96° C. (−140° F.), more preferably below about −106° C. (−160° F.), and even more preferably below about −115° C. (−175° F.).

Similar weld metal chemistries to those mentioned in the examples can be made using either the GMAW or the TIG welding processes. However, the TIG welds are anticipated to have lower impurity content and a more highly refined microstructure than the GMAW welds, and thus improved low temperature toughness.

A person of skill in the art has the requisite knowledge and skill to use the information provided herein to weld ultra-high strength, low alloy steel plates to produce joints or seams having suitable high strength and fracture toughness for use in constructing the process components, containers, and pipes of the present invention. Other suitable joining or welding methods may exist or be developed hereafter. All such joining or welding methods are within the scope of the present invention.

Construction of Process Components, Containers, and Pipes

Process components, containers, and pipes constructed from materials comprising an ultra-high strength, low alloy steel containing less than 9 wt % nickel and having tensile strengths greater than 830 MPa (120 ksi) and DBTTs lower than about −73° C. (−100° F.) are provided. Preferably the ultra-high strength, low alloy steel contains less than about 7 wt % nickel, and more preferably contains less than about 5 wt % nickel. Preferably the ultra-high strength, low alloy steel has a tensile strength greater than about 860 MPa (125 ksi), and more preferably greater than about 900 MPa (130 ksi). Even more preferably, the process components, containers, and pipes of this invention are constructed from materials comprising an ultra-high strength, low alloy steel containing less than about 3 wt % nickel and having a tensile strength exceeding about 1000 MPa (145 ksi) and a DBTT lower than about −73° C. (−100° F.).

The process components, containers, and pipes of this invention are preferably constructed from discrete plates of ultra-high strength, low alloy steel with excellent cryogenic temperature toughness. The joints or seams of the components, containers, and pipes preferably have about the same strength and toughness as the ultra-high strength, low alloy steel plates. In some cases, an undermatching of the strength on the order of about 5% to about 10% may be justified for locations of lower stress. Joints or seams with the preferred properties can be made by any suitable joining technique. An exemplary joining technique is described herein, under the subheading "Joining Methods for Construction of Process Components, Containers, and Pipes".

As will be familiar to those skilled in the art, the Charpy V-notch (CVN) test can be used for the purpose of fracture toughness assessment and fracture control in the design of process components, containers, and pipes for processing and transporting pressurized, cryogenic temperature fluids, particularly through use of the ductile-to-brittle transition temperature (DBTT). The DBTT delineates two fracture regimes in structural steels. At temperatures below the DBTT, failure in the Charpy V-notch test tends to occur by low energy cleavage (brittle) fracture, while at temperatures above the DBTT, failure tends to occur by high energy ductile fracture. Containers that are constructed from welded steels for the load-bearing, cryogenic temperature service must have DBTTs, as determined by the Charpy V-notch test, well below the service temperature of the structure in order to avoid brittle failure. Depending on the design, the service conditions, and/or the requirements of the applicable classification society, the required DBTT temperature shift may be from 5° C. to 30° C. (9° F. to 54° F.) below the service temperature.

As will be familiar to those skilled in the art, the operating conditions taken into consideration in the design of storage containers constructed from a welded steel for transporting pressurized, cryogenic fluids, include among other things, the operating pressure and temperature, as well as additional stresses that are likely to be imposed on the steel and the weldments (see Glossary). Standard fracture mechanics measurements, such as (i) critical stress intensity factor ($K_{IC}$), which is a measurement of plane-strain fracture toughness, and (ii) crack tip opening displacement (CTOD), which can be used to measure elastic-plastic fracture toughness, both of which are familiar to those skilled in the art, may be used to determine the fracture toughness of the steel and the weldments. Industry codes generally acceptable for steel structure design, for example, as presented in the BSI publication "Guidance on methods for assessing the acceptability of flaws in fusion welded structures", often referred to as "PD 6493:1991", may be used to determine the maximum allowable flaw sizes for the containers based on the fracture toughness of the steel and weldment (including HAZ) and the imposed stresses on the container. A person skilled in the art can develop a fracture control program to mitigate fracture initiation through (i) appropriate container design to minimize imposed stresses, (ii) appropriate manufacturing quality control to minimize defects, (iii) appropriate control of life cycle loads and pressures applied to the container, and (iv) an appropriate inspection program to reliably detect flaws and defects in the container. A preferred design philosophy for the system of the present invention is "leak before failure", as is familiar to those skilled in the art. These considerations are generally referred to herein as "known principles of fracture mechanics."

The following is a non-limiting example of application of these known principles of fracture mechanics in a procedure for calculating critical flaw depth for a given flaw length for use in a fracture control plan to prevent fracture initiation in a pressure vessel, such as a process container according to this invention.

Figure 13A:
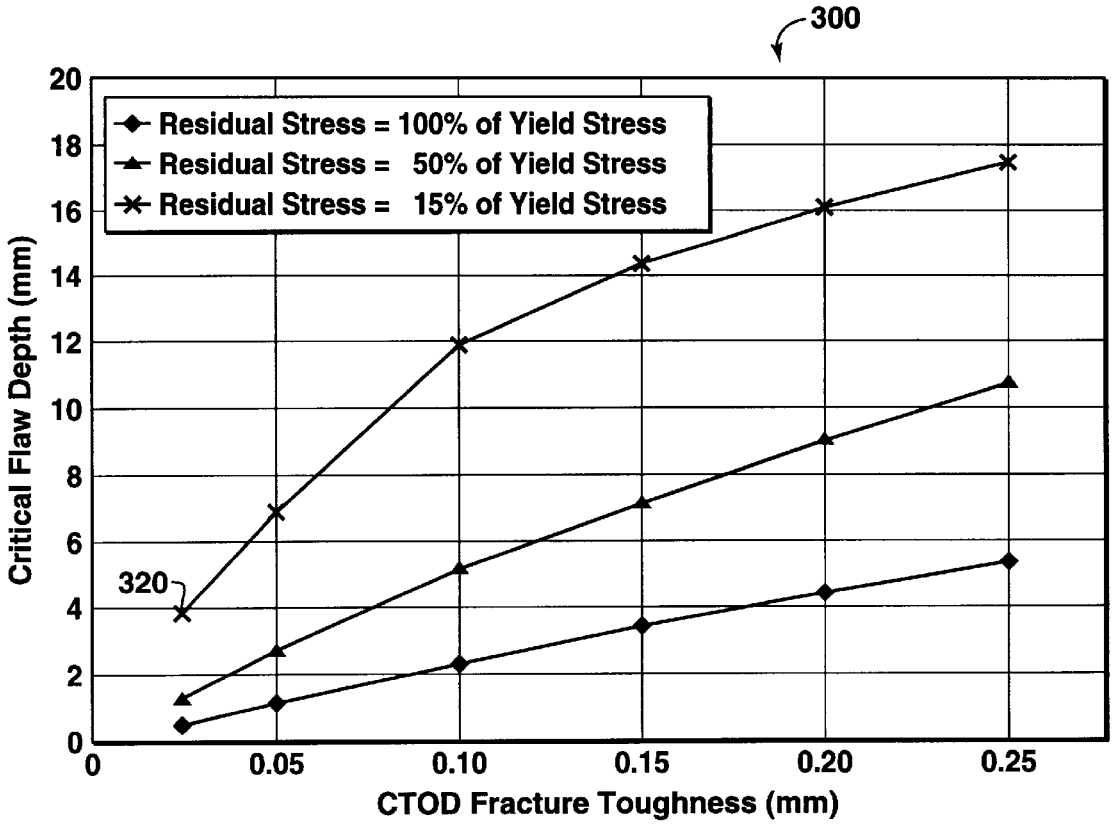
FIG. 13A illustrates a plot of critical flaw depth, for a given flaw length, as a function of CTOD fracture toughness and of residual stress.
Figure 13B:
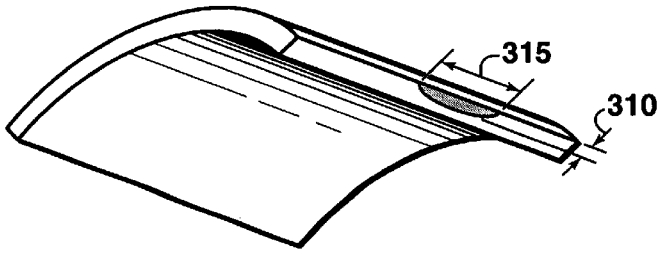
FIG. 13B illustrates the geometry (length and depth) of a flaw.

FIG. 13B illustrates a flaw of flaw length 315 and flaw depth 310. PD6493 is used to calculate values for the critical flaw size plot 300 shown in FIG. 13A based on the following design conditions for a pressure vessel, such as a container according to this invention:

| | |
|---|---|
| Vessel Diameter: | 4.57 m (15 ft) |
| Vessel Wall Thickness: | 25.4 mm (1.00 in.) |
| Design Pressure: | 3445 kPa (500 psi) |
| Allowable Hoop Stress: | 333 MPa (48.3 ksi). |

For the purpose of this example, a surface flaw length of 100 mm (4 inches), e.g., an axial flaw located in a seam weld, is assumed. Referring now to FIG. 13A, plot 300 shows the value for critical flaw depth as a function of CTOD fracture toughness and of residual stress, for residual stress levels of 15, 50 and 100 percent of yield stress. Residual stresses can be generated due to fabrication and welding; and PD6493 recommends the use of a residual stress value of 100 percent of yield stress in welds (including the weld HAZ) unless the welds are stress relieved using techniques such as post weld heat treatment (PWHT) or mechanical stress relief.

Based on the CTOD fracture toughness of the steel at the minimum service temperature, the container fabrication can be adjusted to reduce the residual stresses and an inspection program can be implemented (for both initial inspection and in-service inspection) to detect and measure flaws for comparison against critical flaw size. In this example, if the steel has a CTOD toughness of 0.025 mm at the minimum service temperature (as measured using laboratory specimens) and the residual stresses are reduced to 15 percent of the steel yield strength, then the value for critical flaw depth is approximately 4 mm (see point 320 on FIG. 13A). Following similar calculation procedures, as are well known to those skilled in the art, critical flaw depths can be determined for various flaw lengths as well as various flaw geometries. Using this information, a quality control program and inspection program (techniques, detectable flaw dimensions, frequency) can be developed to ensure that flaws are detected and remedied prior to reaching the critical flaw depth or prior to the application of the design loads. Based on published empirical correlations between CVN, $K_{IC}$ and CTOD fracture toughness, the 0.025 mm CTOD toughness generally correlates to a CVN value of about 37 J. This example is not intended to limit this invention in any way.

For process components, containers, and pipes that require bending of the steel, e.g., into a cylindrical shape for a container or into a tubular shape for a pipe, the steel is preferably bent into the desired shape at ambient temperature in order to avoid detrimentally affecting the excellent cryogenic temperature toughness of the steel. If the steel must be heated to achieve the desired shape after bending, the steel is preferably heated to a temperature no higher than about 600° C. (1112° F.) in order to preserve the beneficial effects of the steel microstructure as described above.

Cryogenic Process Components

Process components constructed from materials comprising an ultra-high strength, low alloy steel containing less than 9 wt % nickel and having tensile strengths greater than 830 MPa (120 ksi) and DBTTs lower than about −73° C. (−100° F.) are provided. Preferably the ultra-high strength, low alloy steel contains less than about 7 wt % nickel, and more preferably contains less than about 5 wt % nickel. Preferably the ultra-high strength, low alloy steel has a tensile strength greater than about 860 MPa (125 ksi), and more preferably greater than about 900 MPa (130 ksi). Even more preferably, the process components of this invention are constructed from materials comprising an ultra-high strength, low alloy steel containing less than about 3 wt % nickel and having a tensile strength exceeding about 1000 MPa (145 ksi) and a DBTT lower than about −73° C. (−100° F.). Such process components are preferably constructed from the ultra-high strength, low alloy steels with excellent cryogenic temperature toughness described herein.

In cryogenic temperature power generation cycles, the primary process components include, for example, condensers, pump systems, vaporizers, and evaporators. In refrigeration systems, liquefaction systems, and air separation plants, the primary process components include, for example, heat exchangers, process columns, separators, and expansion valves or turbines. Flare systems are frequently subjected to cryogenic temperatures, for example, when used in relief systems for ethylene or a natural gas in a low temperature separation process. FIG. 1 illustrates how some of these components are used in a demethanizer gas plant and is further discussed below. Without thereby limiting this invention, particular components, constructed according to the present invention, are described in greater detail below.

Heat Exchangers

Heat exchangers, or heat exchanger systems, constructed according to this invention, are provided. Components of such heat exchanger systems are preferably constructed from the ultra-high strength, low alloy steels with excellent cryogenic temperature toughness described herein. Without thereby limiting this invention, the following examples illustrate various types of heat exchanger systems according to this invention.

Figure 2:
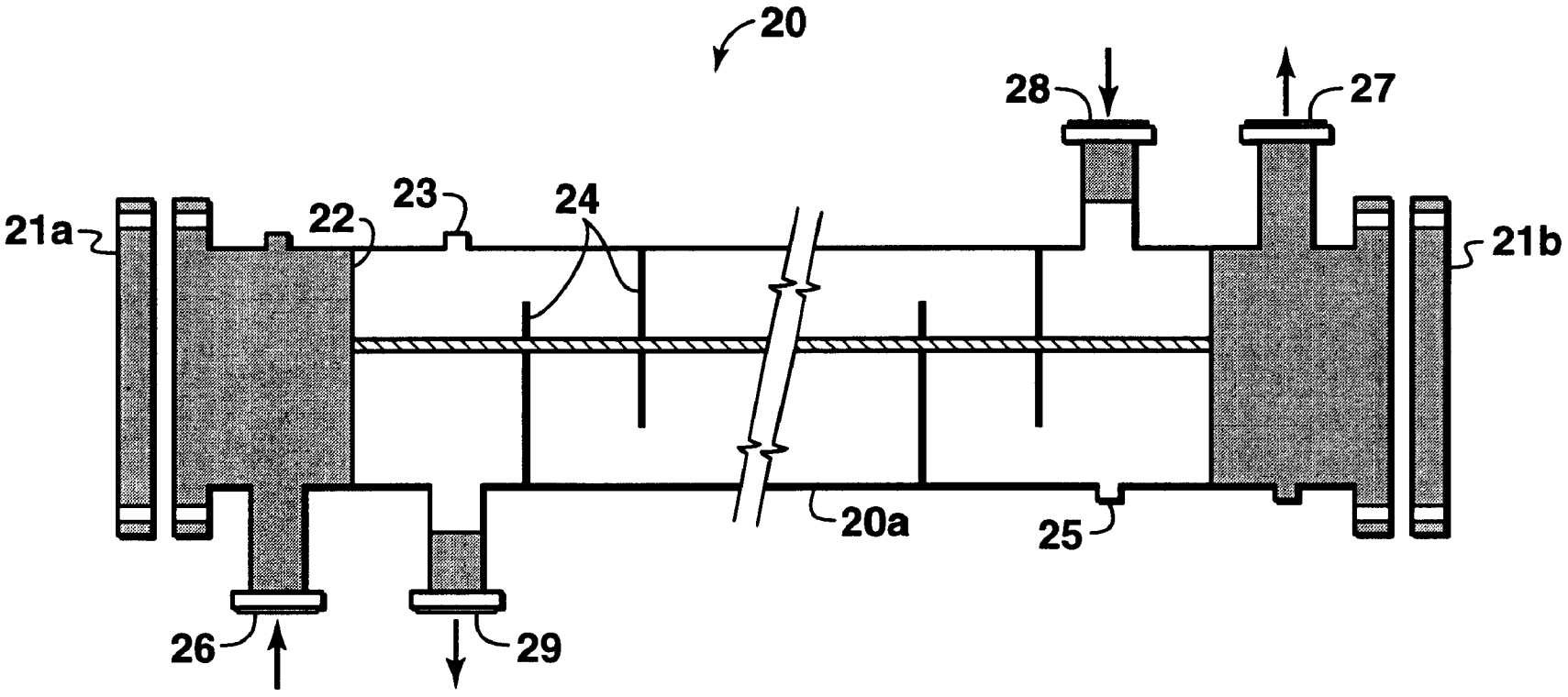
FIG. 2 illustrates a fixed tubesheet, single pass heat exchanger according to the present invention.

For example, FIG. 2 illustrates a fixed tubesheet, single pass heat exchanger system 20 according to the present invention. In one embodiment, fixed tubesheet, single pass heat exchanger system 20 includes heat exchanger body 20*a*, channel covers 21*a* and 21*b*, a tubesheet 22 (the tubesheet 22 header is shown in FIG. 2), a vent 23, baffles 24, a drain 25, a tube inlet 26, a tube outlet 27, a shell inlet 28, and a shell outlet 29. Without thereby limiting this invention, the following example applications illustrate the advantageous utility of fixed tubesheet, single pass heat exchanger system 20 according to the present invention.

Fixed Tubesheet Example No. 1

In a first example application, fixed tubesheet, single pass heat exchanger system 20 is used as an inlet gas cross-exchanger in a cryogenic gas plant with demethanizer overheads on the shell side and inlet gas on the tubeside. The inlet gas enters fixed tubesheet, single pass heat exchanger system 20 through tube inlet 26 and exits through tube outlet 27, while the demethanizer overheads fluid enters through shell inlet 28 and exits through shell outlet 29.

Fixed Tubesheet Example No. 2

In a second example application, fixed tubesheet, single pass heat exchanger system 20 is used as a side reboiler on a cryogenic demethanizer with precooled feed on the tubeside and cryogenic column sidestream liquids boiling on the shell side to remove methane from the bottoms product. The precooled feed enters fixed tubesheet, single pass heat exchanger system 20 through tube inlet 26 and exits through tube outlet 27, while the cryogenic column sidestream liquids enter through shell inlet 28 and exit through shell outlet 29.

Fixed Tubesheet Example No. 3

In another example application, fixed tubesheet, single pass heat exchanger system 20 is used as a side reboiler on a Ryan Holmes product recovery column to remove methane and $CO_2$ from the bottoms product. A precooled feed enters fixed tubesheet, single pass heat exchanger system 20 through tube inlet 26 and exits through tube outlet 27, while cryogenic tower sidestream liquids enter through shell inlet 28 and exit through shell outlet 29.

Fixed Tubesheet Example No. 4

In another example application, fixed tubesheet, single pass heat exchanger system 20 is used as a side reboiler on a CFZ $CO_2$ removal column with a cryogenic liquid sidestream on the shell side and precooled feed gas on the tubeside to remove methane and other hydrocarbons from the $CO_2$-rich bottoms product. The precooled feed enters fixed tubesheet, single pass heat exchanger system 20 through tube inlet 26 and exits through tube outlet 27, while a cryogenic liquid sidestream enters through shell inlet 28 and exits through shell outlet 29.

In Fixed Tubesheet Example Nos. 1–4, heat exchanger body 20*a*, channel covers 21*a* and 21*b*, tubesheet 22, vent 23, and baffles 24 preferably are constructed from steels containing less than about 3 wt % nickel and have adequate strength and fracture toughness to contain the cryogenic temperature fluid being processed, and more preferably are constructed from steels containing less than about 3 wt % nickel and have tensile strengths exceeding about 1000 MPa (145 ksi) and DBTTs lower than about −73° C. (−100° F.). Furthermore, heat exchanger body 20*a*, channel covers 21*a* and 21*b*, tubesheet 22, vent 23, and baffles 24 are preferably constructed from the ultra-high strength, low alloy steels with excellent cryogenic temperature toughness described herein. Other components of fixed tubesheet, single pass heat exchanger system 20 may also be constructed from the ultra-high strength, low alloy steels with excellent cryogenic temperature toughness described herein, or from other suitable materials.

Figure 3:
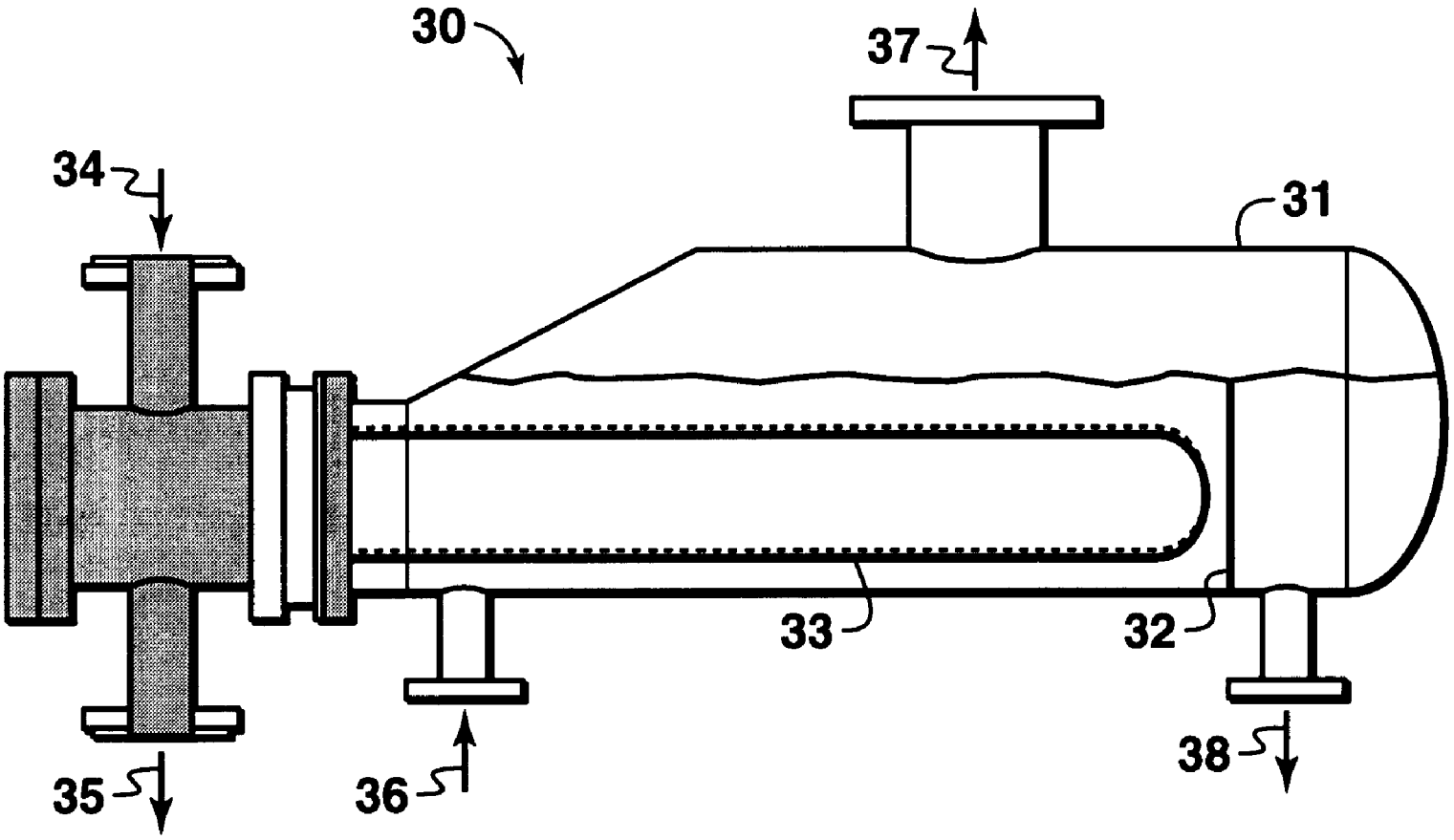
FIG. 3 illustrates a kettle reboiler heat exchanger according to the present invention.

FIG. 3 illustrates a kettle reboiler heat exchanger system 30 according to the present invention. In one embodiment, kettle reboiler heat exchanger system 30 includes a kettle reboiler body 31, a weir 32, a heat exchange tube 33, a tubeside inlet 34, a tubeside outlet 35, a kettle inlet 36, a kettle outlet 37, and a drain 38. Without thereby limiting this invention, the following example applications illustrate the advantageous utility of a kettle reboiler heat exchanger system 30 according to the present invention.

Kettle Reboiler Example No. 1

In a first example, kettle reboiler heat exchanger system 30 is used in a cryogenic gas liquids recovery plant with propane vaporizing at about −40° C. (−40° F.) on the kettle side and hydrocarbon gas on the tubeside. The hydrocarbon gas enters kettle reboiler heat exchanger system 30 through tubeside inlet 34 and exits through tubeside outlet 35, while the propane enters through kettle inlet 36 and exits through kettle outlet 37.

Kettle Reboiler Example No. 2

In a second example, kettle reboiler heat exchanger system 30 is used in a refrigerated lean oil plant with propane vaporizing at about −40° C. (−40° F.) on the kettle side and lean oil on the tubeside. The lean oil enters kettle reboiler heat exchanger system 30 through tube inlet 34 and exits through tube outlet 35, while the propane enters through kettle inlet 36 and exits through kettle outlet 37.

Kettle Reboiler Example No. 3

In another example, kettle reboiler heat exchanger system 30 is used in a Ryan Holmes product recovery column with propane vaporizing at about −40° C. (−40° F.) on the kettle side and product recovery column overhead gas on the tubeside to condense reflux for the tower. The product recovery column overhead gas enters kettle reboiler heat exchanger system 30 through tube inlet 34 and exits through tube outlet 35, while the propane enters through kettle inlet 36 and exits through kettle outlet 37.

Kettle Reboiler Example No. 4

In another example, kettle reboiler heat exchanger system 30 is used in Exxon's CFZ process with refrigerant vaporizing on the kettle side and CFZ tower overhead gas on the tube side to condense liquid methane for tower reflux and keep $CO_2$ out of the overhead methane product stream. The CFZ tower overhead gas enters kettle reboiler heat exchanger system 30 through tube inlet 34 and exits through tube outlet 35, while the refrigerant enters through kettle inlet 36 and exits through kettle outlet 37. The refrigerant preferably comprises propylene or ethylene, as well as a mixture of any or all of components of the group comprising methane, ethane, propane, butane, and pentane.

Kettle Reboiler Example No. 5

In another example, kettle reboiler heat exchanger system 30 is used as a bottoms reboiler on a cryogenic demethanizer with tower bottoms product on the kettle side and hot inlet gas or hot oil on the tube side to remove methane from the bottoms product. The hot inlet gas or hot oil enters kettle reboiler heat exchanger system 30 through tube inlet 34 and exits through tube outlet 35, while the tower bottoms product enters through kettle inlet 36 and exits through kettle outlet 37.

Kettle Reboiler Example No. 6

In another example, kettle reboiler heat exchanger system 30 is used as a bottoms reboiler on a Ryan Holmes product recovery column with bottoms products on the kettle side and hot feed gas or hot oil on the tube side to remove methane and $CO_2$ from the bottoms product. The hot feed gas or hot oil enters kettle reboiler heat exchanger system 30 through tube inlet 34 and exits through tube outlet 35, while the bottoms products enter through kettle inlet 36 and exit through kettle outlet 37.

Kettle Reboiler Example No. 7

In another example, kettle reboiler heat exchanger system 30 is used on a CFZ $CO_2$ removal tower with tower bottoms liquids on the kettle side and hot feed gas or hot oil on the tube side to remove methane and other hydrocarbons from the $CO_2$-rich liquid bottoms stream. The hot feed gas or hot oil enters kettle reboiler heat exchanger system 30 through tube inlet 34 and exits through tube outlet 35, while the tower bottoms liquids enter through kettle inlet 36 and exit through kettle outlet 37.

In Kettle Reboiler Example Nos. 1–7, kettle reboiler body 31, heat exchanger tube 33, weir 32, and port connections for tubeside inlet 34, tubeside outlet 35, kettle inlet 36, and kettle outlet 37 preferably are constructed from steels containing less than about 3 wt % nickel and have adequate strength and fracture toughness to contain the cryogenic fluid being processed, and more preferably are constructed from steels containing less than about 3 wt % nickel and have tensile strengths exceeding about 1000 MPa (145 ksi) and DBTTs lower than about −73° C. (−100° F.). Furthermore, kettle reboiler body 31, heat exchanger tube 33, weir 32, and port connections for tubeside inlet 34, tubeside outlet 35, kettle inlet 36, and kettle outlet 37 are preferably constructed from the ultra-high strength, low alloy steels with excellent cryogenic temperature toughness described herein. Other components of kettle reboiler heat exchanger system 30 may also be constructed from the ultra-high strength, low alloy steels with excellent cryogenic temperature toughness described herein, or from other suitable materials.

The design criteria and method of construction of heat exchanger systems according to this invention are familiar to those skilled in the art, especially in view of the disclosure provided herein.

Condensers

Condensers, or condenser systems, constructed according to this invention, are provided. More particularly, condenser systems, with at least one component constructed according to this invention, are provided. Components of such condenser systems are preferably constructed from the ultra-high strength, low alloy steels with excellent cryogenic temperature toughness described herein. Without thereby limiting this invention, the following examples illustrate various types of condenser systems according to this invention.

Condenser Example No. 1

Referring to FIG. 1, a condenser according to this invention is used in a demethanizer gas plant 10 in which a feed gas stream is separated into a residue gas and a product stream using a demethanizer column 11. In this particular example, the overhead from demethanizer column 11, at a temperature of about −90° C. (−130° F.) is condensed into a reflux accumulator (separator) 15 using reflux condenser system 12. Reflux condenser system 12 exchanges heat with the gaseous discharge stream from expander 13. Reflux condenser system 12 is primarily a heat exchanger system, preferably of the types discussed above. In particular, reflux condenser system 12 may be a fixed tubesheet, single pass heat exchanger (e.g. fixed tubesheet, single pass heat exchanger 20, as illustrated by FIG. 2 and described above). Referring again to FIG. 2, the discharge stream from expander 13 enters fixed tubesheet, single pass heat exchanger system 20 through tube inlet 26 and exits through tube outlet 27 while the demethanizer overhead enters the shell inlet 28 and exits through shell outlet 29.

Condenser Example No. 2

Figure 7:
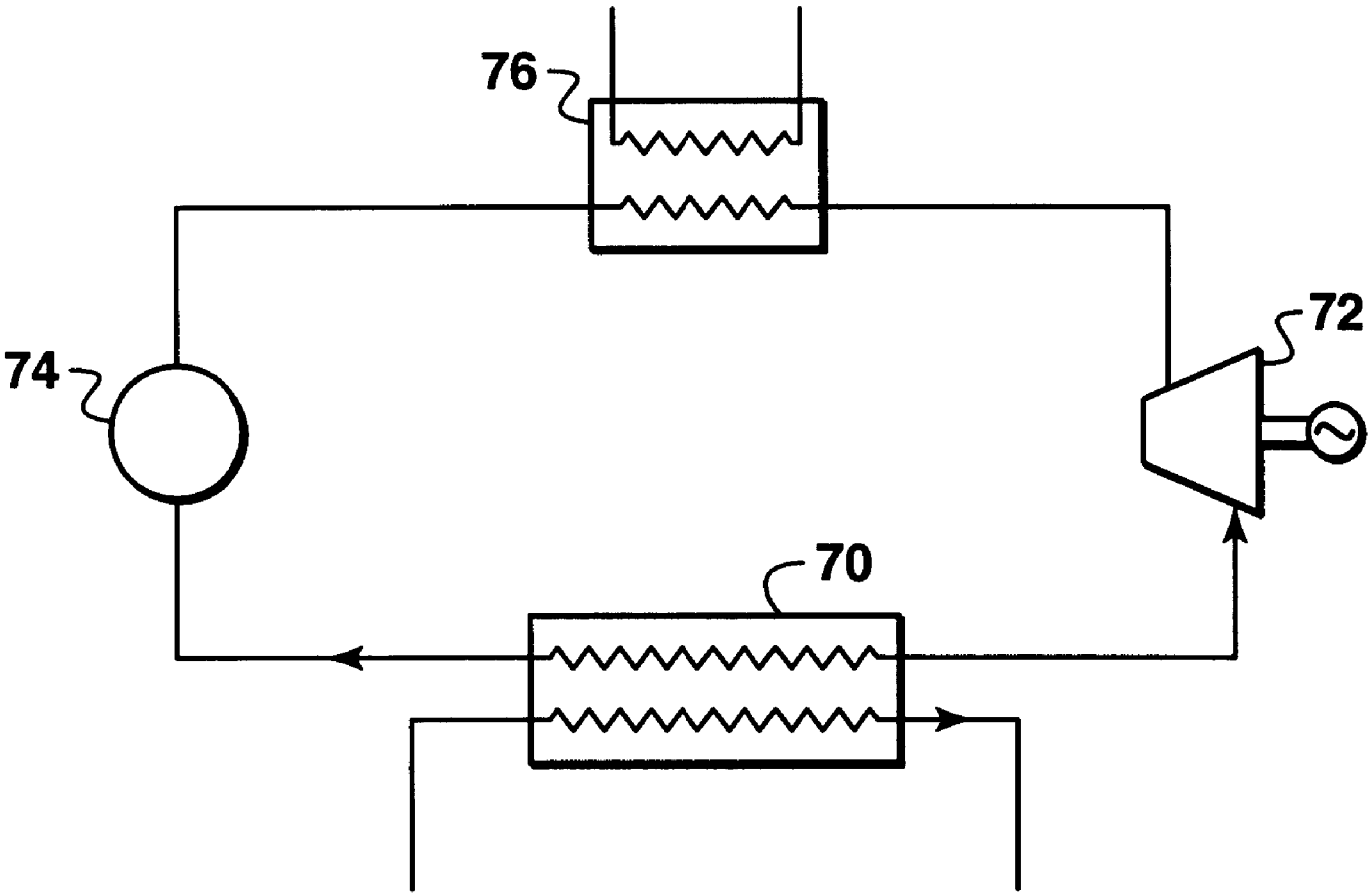
FIG. 7 illustrates a condenser system according to the present invention as used in a reverse Rankine cycle.

Referring now to FIG. 7, a condenser system 70 according to this invention is used in a reverse Rankine cycle for generating power using the cold energy from a cold energy source such as pressurized liquefied natural gas (PLNG) (see Glossary) or conventional LNG (see Glossary). In this particular example, the power fluid is used in a closed thermodynamic cycle. The power fluid, in gaseous form, is expanded in turbine 72 and then fed as gas into condenser system 70. The power fluid exits condenser system 70 as a single phase liquid and is pumped by pump 74 and subsequently vaporized by vaporizer 76 before returning to the inlet of turbine 72. Condenser system 70 is primarily a heat exchanger system, preferably of the types discussed above.

In particular, condenser system 70 may be a fixed tubesheet, single pass heat exchanger (e.g. fixed tubesheet, single pass heat exchanger 20, as illustrated by FIG. 2 and described above).

Referring again to FIG. 2, in Condenser Example Nos. 1 and 2, heat exchanger body 20*a*, channel covers 21*a* and 21*b*, tubesheet 22, vent 23, and baffles 24 preferably are constructed from ultra-high strength, low alloy steels containing less than about 3 wt % nickel and have adequate strength and cryogenic temperature fracture toughness to contain the cryogenic fluid being processed, and more preferably are constructed from ultra-high strength, low alloy steels containing less than about 3 wt % nickel and have tensile strengths exceeding about 1000 MPa (145 ksi) and DBTTs lower than about −73° C. (−100° F.). Furthermore, heat exchanger body 20*a*, channel covers 21*a* and 21*b*, tubesheet 22, vent 23, and baffles 24 are preferably constructed from the ultra-high strength, low alloy steels with excellent cryogenic temperature toughness described herein. Other components of condenser system 70 may also be constructed from the ultra-high strength, low alloy steels with excellent cryogenic temperature toughness described herein, or from other suitable materials.

Condenser Example No. 3

Figure 8:
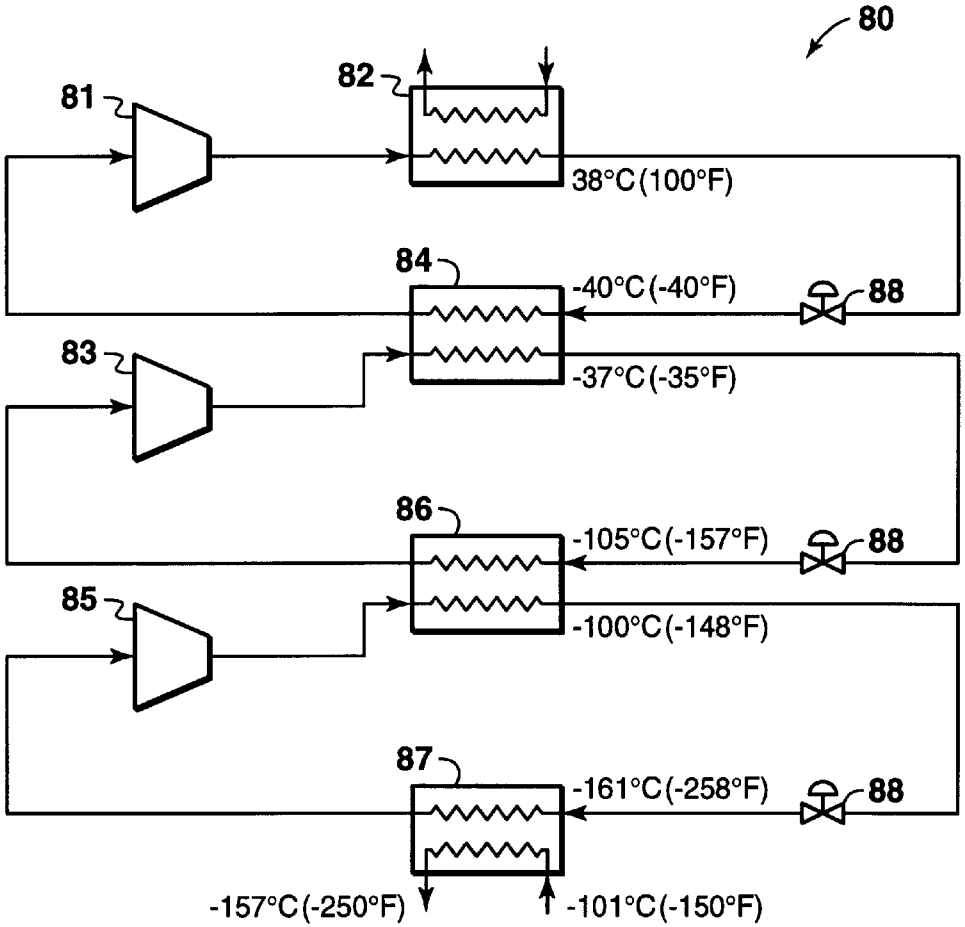
FIG. 8 illustrates a condenser according to the present invention as used in a cascade refrigeration cycle.

Referring now to FIG. 8, a condenser according to this invention is used in a cascade refrigeration cycle 80 consisting of several staged compression cycles. The major items of equipment of cascade refrigeration cycle 80 include propane compressor 81, propane condenser 82, ethylene compressor 83, ethylene condenser 84, methane compressor 85, methane condenser 86, methane evaporator 87, and expansion valves 88. Each stage operates at successively lower temperatures by the selection of a series of refrigerants with boiling points that span the temperature range required for the complete refrigeration cycle. In this example cascade cycle, the three refrigerants, propane, ethylene, and methane, may be used in an LNG process with the typical temperatures indicated on FIG. 8. In this example, all parts of methane condenser 86 and of ethylene condenser 84 preferably are constructed from ultra-high strength, low alloy steels containing less than about 3 wt % nickel and have adequate strength and cryogenic temperature fracture toughness to contain the cryogenic fluid being processed, and more preferably are constructed from ultra-high strength, low alloy steels containing less than about 3 wt % nickel and have tensile strengths exceeding about 1000 MPa (145 ksi) and DBTTs lower than about −73° C. (−100° F.). Furthermore, all parts of methane condenser 86 and of ethylene condenser 84 are preferably constructed from the ultra-high strength, low alloy steels with excellent cryogenic temperature toughness described herein. Other components of cascade refrigeration cycle 80 may also be constructed from the ultra-high strength, low alloy steels with excellent cryogenic temperature toughness described herein, or from other suitable materials.

The design criteria and method of construction of condenser systems according to this invention are familiar to those skilled in the art, especially in view of the disclosure provided herein.

Vaporizers/Evaporators

Vaporizers/evaporators, or vaporizer systems, constructed according to this invention, are provided. More particularly, vaporizer systems, with at least one component constructed according to this invention, are provided. Components of such vaporizer systems are preferably constructed from the ultra-high strength, low alloy steels with excellent cryogenic temperature toughness described herein. Without thereby limiting this invention, the following examples illustrate various types of vaporizer systems according to this invention.

Vaporizer Example No. 1

In a first example, a vaporizer system according to this invention is used in a reverse Rankine cycle for generating power using the cold energy from a cold energy source such as pressurized LNG (as defined herein) or conventional LNG (as defined herein). In this particular example, a process stream of PLNG from a transportation storage container is completely vaporized using the vaporizer. The heating medium may be power fluid used in a closed thermodynamic cycle, such as a reverse Rankine cycle, to generate power. Alternatively, the heating medium may consist of a single fluid used in an open loop to completely vaporize the PLNG, or several different fluids with successively higher freezing points used to vaporize and successively warm the PLNG to ambient temperature. In all cases, the vaporizer serves the function of a heat exchanger, preferably of the types described in detail herein under the subheading "Heat Exchangers". The mode of application of the vaporizer and the composition and properties of the stream or streams processed determine the specific type of heat exchanger required. As an example, referring again to FIG. 2, where use of fixed tubesheet, single pass heat exchanger system 20 is applicable, a process stream, such as PLNG, enters fixed tubesheet single pass heat exchanger system 20 through tube inlet 26 and exits through tube outlet 27, while the heating medium enters through shell inlet 28 and exits through shell outlet 29. In this example, heat exchanger body 20*a*, channel covers 21*a* and 21*b*, tubesheet 22, vent 23, and baffles 24 preferably are constructed from steels containing less than about 3 wt % nickel and have adequate strength and fracture toughness to contain the cryogenic temperature fluid being processed, and more preferably are constructed from steels containing less than about 3 wt % nickel and have tensile strengths exceeding about 1000 MPa (145 ksi) and DBTTs lower than about −73° C. (−100° F.). Furthermore, heat exchanger body 20*a*, channel covers 21*a* and 21*b*, tubesheet 22, vent 23, and baffles 24 are preferably constructed from the ultra-high strength, low alloy steels with excellent cryogenic temperature toughness described herein. Other components of fixed tubesheet, single pass heat exchanger system 20 may also be constructed from the ultra-high strength, low alloy steels with excellent cryogenic temperature toughness described herein, or from other suitable materials.

Vaporizer Example No. 2

Figure 9:
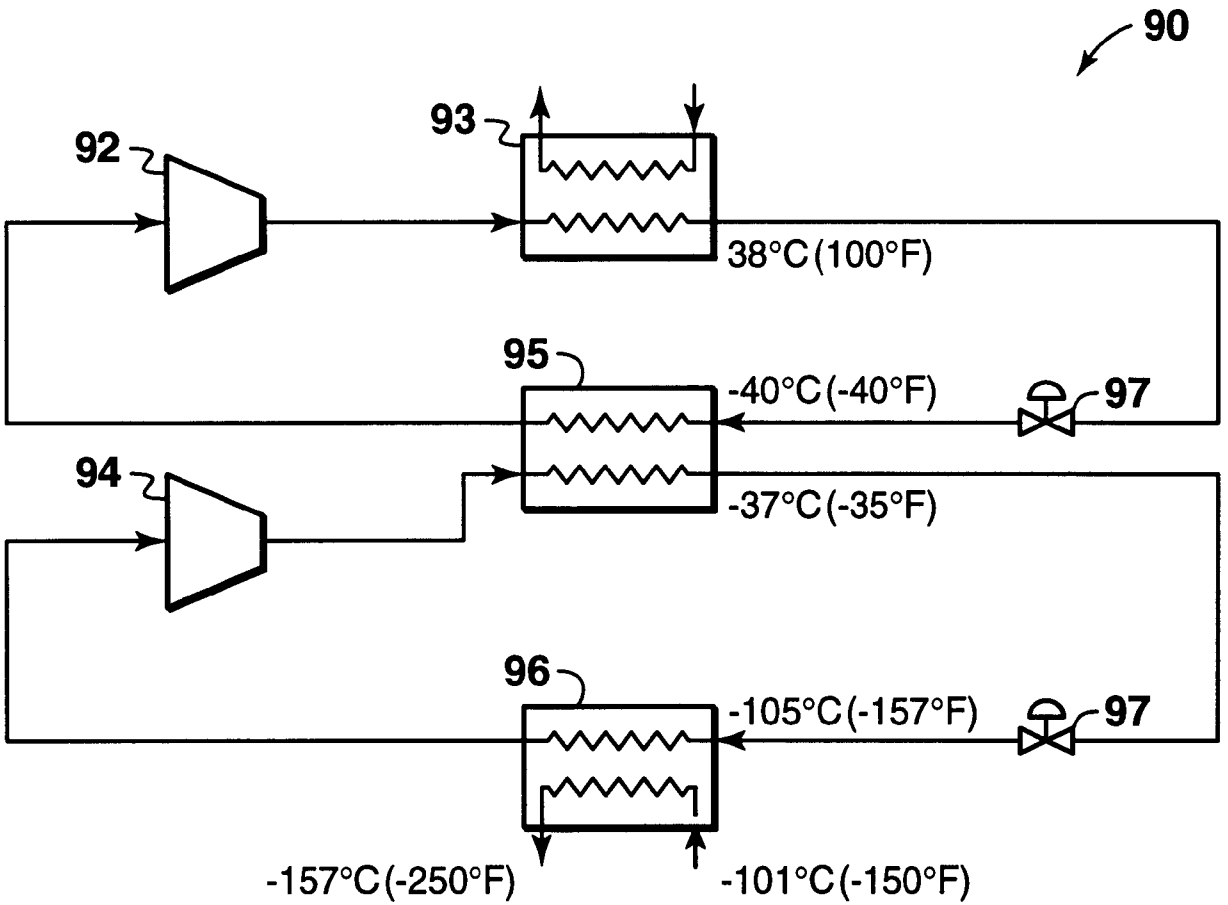
FIG. 9 illustrates a vaporizer according to the present invention as used in a cascade refrigeration cycle.

In another example, a vaporizer according to this invention is used in a cascade refrigeration cycle consisting of several staged compression cycles, as illustrated by FIG. 9. Referring to FIG. 9, each of the two staged compression cycles of cascade cycle 90 operates at successively lower temperatures by the selection of a series of refrigerants with boiling points that span the temperature range required for the complete refrigeration cycle. The major items of equipment in cascade cycle 90 include propane compressor 92, propane condenser 93, ethylene compressor 94, ethylene condenser 95, ethylene evaporator 96, and expansion valves 97. In this example, the two refrigerants propane and ethylene are used in a PLNG liquefaction process with the typical temperatures indicated. Ethylene evaporator 96 preferably is constructed from steels containing less than about 3 wt % nickel and has adequate strength and fracture toughness to contain the cryogenic temperature fluid being processed, and more preferably is constructed from steels containing less than about 3 wt % nickel and has a tensile strength exceeding about 1000 MPa (145 ksi) and a DBTT lower than about −73° C. (−100° F.). Furthermore, ethylene evaporator 96 is preferably constructed from the ultra-high strength, low alloy steels with excellent cryogenic temperature toughness described herein. Other components of cascade cycle 90 may also be constructed from the ultra-high strength, low alloy steels with excellent cryogenic temperature toughness described herein, or from other suitable materials.

The design criteria and method of construction of vaporizer systems according to this invention are familiar to those skilled in the art, especially in view of the disclosure provided herein.

Separators

Separators, or separator systems, (i) constructed from ultra-high strength, low alloy steels containing less than about 3 wt % nickel and (ii) having adequate strength and cryogenic temperature fracture toughness to contain cryogenic temperature fluids, are provided. More particularly, separator systems, with at least one component (i) constructed from an ultra-high strength, low alloy steel containing less than about 3 wt % nickel and (ii) having a tensile strength exceeding about 1000 MPa (145 ksi) and a DBTT lower than about −73° C. (−100° F.), are provided. Components of such separator systems are preferably constructed from the ultra-high strength, low alloy steels with excellent cryogenic temperature toughness described herein. Without thereby limiting this invention, the following example illustrates a separator system according to this invention.

Figure 4:
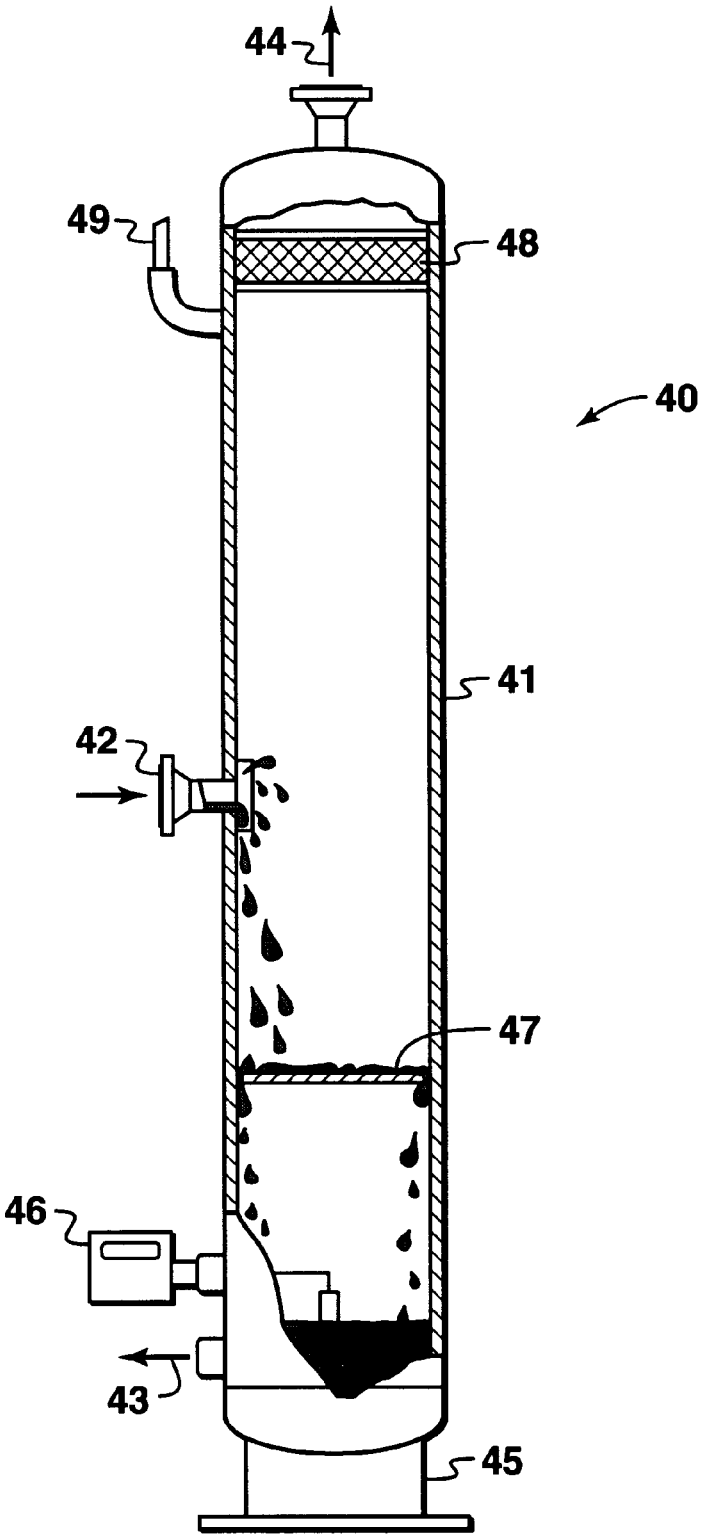
FIG. 4 illustrates an expander feed separator according to the present invention.

FIG. 4 illustrates a separator system 40 according to the present invention. In one embodiment, separator system 40 includes vessel 41, inlet port 42, liquid outlet port 43, gas outlet 44, support skirt 45, liquid level controller 46, isolation baffle 47, mist extractor 48, and pressure relief valve 49. In one example application, without thereby limiting this invention, separator system 40 according to the present invention is advantageously utilized as an expander feed separator in a cryogenic gas plant to remove condensed liquids upstream of an expander. In this example, vessel 41, inlet port 42, liquid outlet port 43, support skirt 45, mist extractor supports 48, and isolation baffle 47 are preferably constructed from steels containing less than about 3 wt % nickel and have adequate strength and fracture toughness to contain the cryogenic temperature fluid being processed, and more preferably are constructed from steels containing less than about 3 wt % nickel and have tensile strengths exceeding about 1000 MPa (145 ksi) and DBTTs lower than about −73° C. (−100° F.). Furthermore, vessel 41, inlet port 42, liquid outlet port 43, support skirt 45, mist extractor supports 48, and isolation baffle 47 are preferably constructed from the ultra-high strength, low alloy steels with excellent cryogenic temperature toughness described herein. Other components of separator system 40 may also be constructed from the ultra-high strength, low alloy steels with excellent cryogenic temperature toughness described herein, or from other suitable materials.

The design criteria and method of construction of separator systems according to this invention are familiar to those skilled in the art, especially in view of the disclosure provided herein.

Process Columns

Process columns, or process column systems, constructed according to this invention, are provided. Components of such process column systems are preferably constructed from the ultra-high strength, low alloy steels with excellent cryogenic temperature toughness described herein. Without thereby limiting this invention, the following examples illustrate various types of process column systems according to this invention.

Process Column Example No. 1

Figure 11:
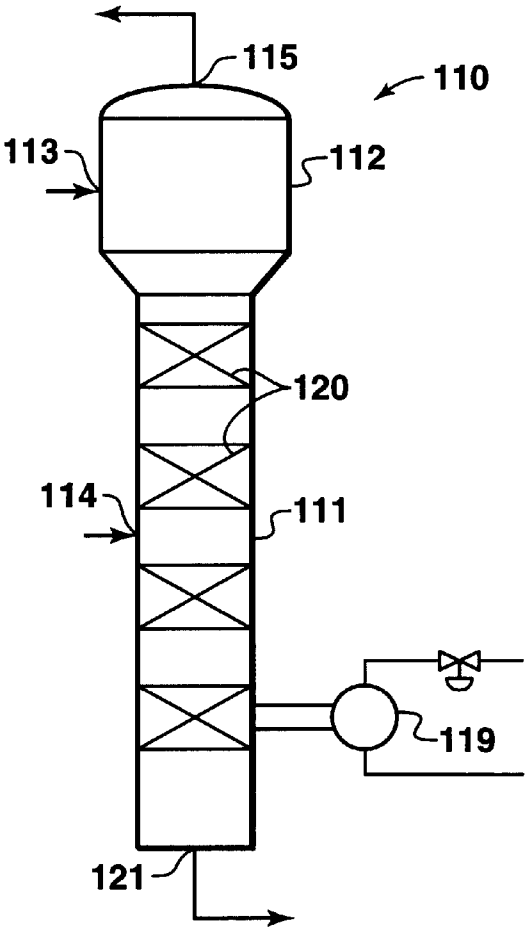
FIG. 11 illustrates a process column system according to the present invention.

FIG. 11 illustrates a process column system according to the present invention. In this embodiment, demethanizer process column system 110 includes column 111, separator bell 112, first inlet 113, second inlet 114, liquid outlet 121, vapor outlet 115, reboiler 119, and packing 120. In one example application, without thereby limiting this invention, process column system 110 according to the present invention is advantageously utilized as a demethanizer in a cryogenic gas plant to separate methane from the other condensed hydrocarbons. In this example, column 111, separator bell 112, packing 120, and other internals commonly used in such a process column system 110 are preferably constructed from steels containing less than about 3 wt % nickel and have adequate strength and fracture toughness to contain the cryogenic temperature fluid being processed, and more preferably are constructed from steels containing less than about 3 wt % nickel and have tensile strengths exceeding about 1000 MPa (145 ksi) and DBTTs lower than about −73° C. (−100° F.). Furthermore, column 111, separator bell 112, packing 120, and other internals commonly used in such a process column system 110 are preferably constructed from the ultra-high strength, low alloy steels with excellent cryogenic temperature toughness described herein. Other components of process column system 110 may also be constructed from ultra-high strength, low alloy steels with excellent cryogenic temperature toughness described herein, or from other suitable materials.

Process Column Example No. 2

Figure 12:
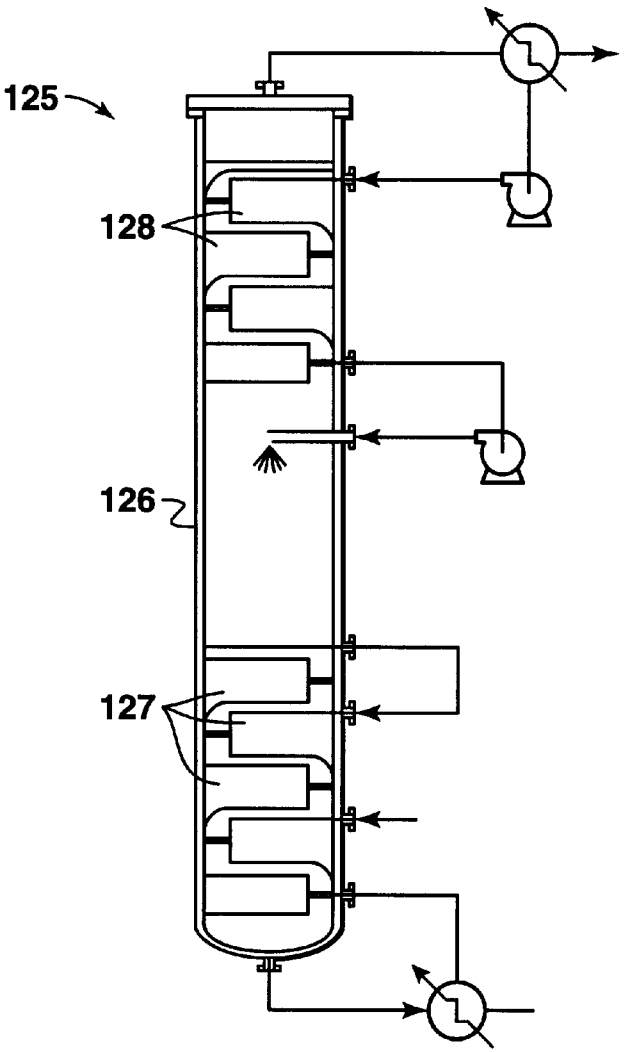
FIG. 12 illustrates another process column system according to the present invention.

FIG. 12 illustrates a process column system 125 according to the present invention. In this example, process column system 125 is advantageously utilized as a CFZ tower in a CFZ process for separating $CO_2$ from methane. In this example, column 126, melting trays 127, and contacting trays 128 are preferably constructed from steels containing less than about 3 wt % nickel and have adequate strength and fracture toughness to contain the cryogenic temperature fluid being processed, and more preferably are constructed from steels containing less than about 3 wt % nickel and have tensile strengths exceeding about 1000 MPa (145 ksi) and DBTTs lower than about −73° C. (−100° F.). Furthermore, column 126, melting trays 127, and contacting trays 128 are preferably constructed from the ultra-high strength, low alloy steels with excellent cryogenic temperature toughness described herein. Other components of process column system 125 may also be constructed from the ultra-high strength, low alloy steels with excellent cryogenic temperature toughness described herein, or from other suitable materials.

The design criteria and method of construction of process columns according to this invention are familiar to those skilled in the art, especially in view of the disclosure provided herein.

Pump Components and Systems

Pumps, or pump systems, constructed according to this invention, are provided. Components of such pump systems are preferably constructed from the ultra-high strength, low alloy steels with excellent cryogenic temperature toughness described herein. Without thereby limiting this invention, the following example illustrates a pump system according to this invention.

Figure 10:
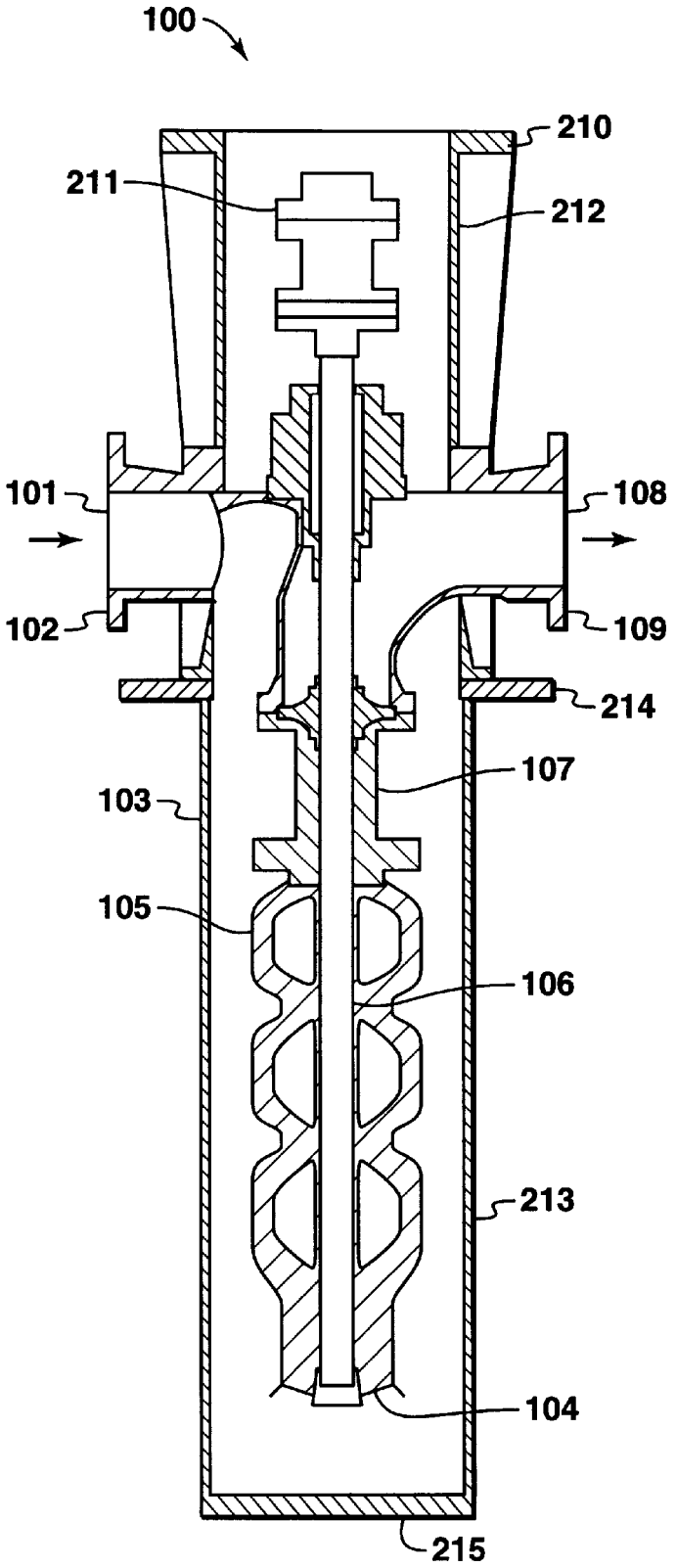
FIG. 10 illustrates a pump system according to the present invention.

Referring now to FIG. 10, pump system 100 is constructed according to this invention. Pump system 100 is made from substantially cylindrical and plate components. A cryogenic fluid enters cylindrical fluid inlet 101 from a pipe attached to inlet flange 102. The cryogenic fluid flows inside cylindrical casing 103 to pump inlet 104 and into multi-stage pump 105 where it undergoes an increase in pressure energy. Multi-stage pump 105 and drive shaft 106 are supported by a cylindrical bearing and pump support housing (not shown in FIG. 10). The cryogenic fluid leaves pump system 100 through fluid outlet 108 in a pipe attached to fluid exit flange 109. A driving means such as an electric motor (not shown in FIG. 10) is mounted on the drive mounting flange 210 and attached to pump system 100 through drive coupling 211. Drive mounting flange 210 is supported by cylindrical coupling housing 212. In this example, pump system 100 is mounted between pipe flanges (not shown in FIG. 10); but other mounting systems are also applicable, such as submerging pump system 100 in a tank or vessel such that the cryogenic liquid enters directly into fluid inlet 101 without the connecting pipe. Alternatively, pump system 100 is installed in another housing or "pump pot", where both fluid inlet 101 and fluid outlet 108 are connected to the pump pot, and pump system 100 is readily removable for maintenance or repair. In this example, pump casing 213, inlet flange 102, drive coupling housing 212, drive mounting flange 210, mounting flange 214, pump end plate 215, and pump and bearing support housing 217 are all preferably constructed from steels containing less than 9 wt % nickel and having tensile strengths greater than 830 MPa (120 ksi) and DBTTs lower than about −73° C. (−100° F.), and more preferably are constructed from steels containing less than about 3 wt % nickel and having tensile strengths greater than about 1000 MPa (145 ksi) and DBTTs lower than about −73° C. (−100° F.). Furthermore, pump casing 213, inlet flange 102, drive coupling housing 212, drive mounting flange 210, mounting flange 214, pump end plate 215, and pump and bearing support housing 217 are preferably constructed from the ultra-high strength, low alloy steels with excellent cryogenic temperature toughness described herein. Other components of pump system 100 may also be constructed from the ultra-high strength, low alloy steels with excellent cryogenic temperature toughness described herein, or from other suitable materials.

The design criteria and method of construction of pump components and systems according to this invention are familiar to those skilled in the art, especially in view of the disclosure provided herein.

Flare Components and Systems

Flares, or flare systems, constructed according to this invention, are provided. Components of such flare systems are preferably constructed from the ultra-high strength, low alloy steels with excellent cryogenic temperature toughness described herein. Without thereby limiting this invention, the following example illustrates a flare system according to this invention.

Figure 5:
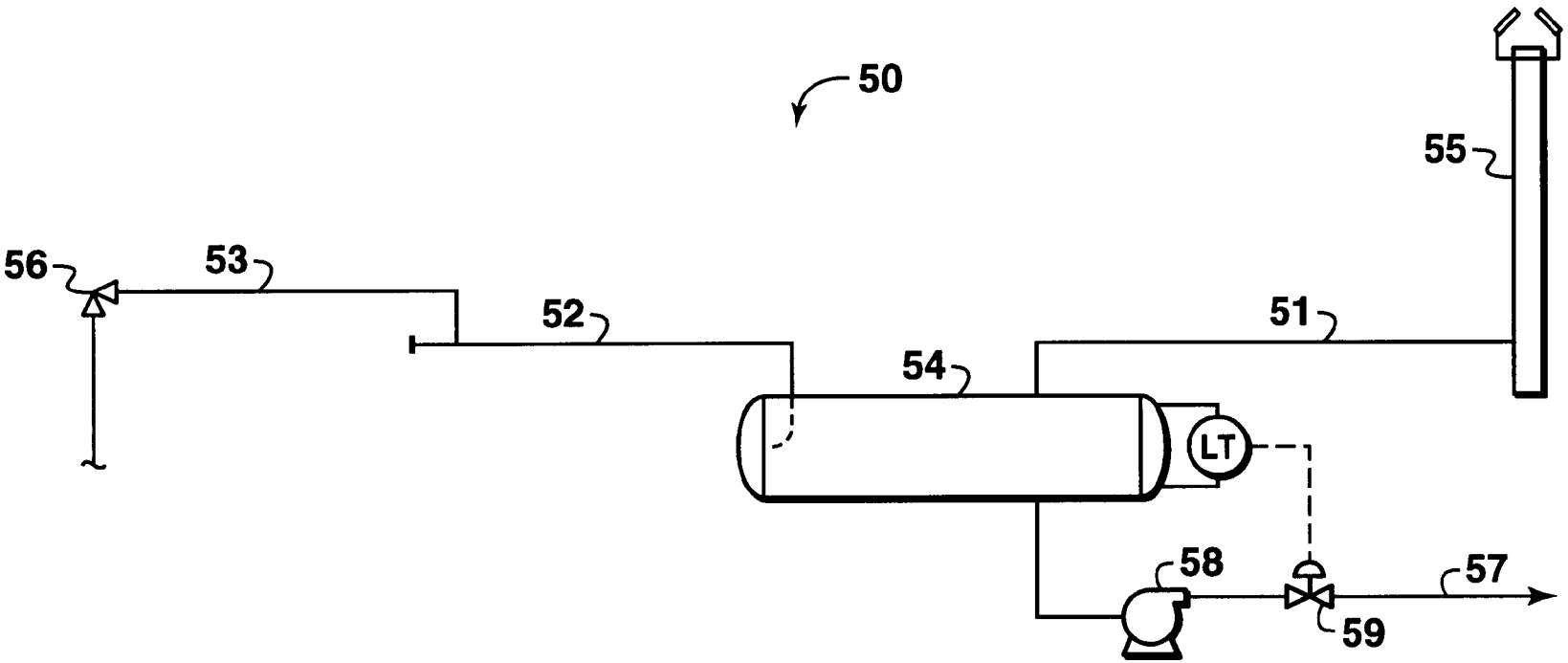
FIG. 5 illustrates a flare system according to the present invention.

FIG. 5 illustrates a flare system 50 according to the present invention. In one embodiment, flare system 50 includes blowdown valves 56, piping, such as lateral line 53, collection header line 52, and flare line 51, and also includes a flare scrubber 54, a flare stack or boom 55, a liquid drain line 57, a drain pump 58, a drain valve 59, and auxiliaries (not shown in FIG. 5) such as ignitors and purge gas. Flare system 50 typically handles combustible fluids that are at cryogenic temperatures due to process conditions or that cool to cryogenic temperatures upon relief to flare system 50, i.e., from a large pressure drop across relief valves or blowdown valves 56. Flare line 51, collection header line 52, lateral line 53, flare scrubber 54, and any additional associated piping or systems that would be exposed to the same cryogenic temperatures as flare system 50 are all preferably constructed from steels containing less than 9 wt % nickel and having tensile strengths greater than 830 MPa (120 ksi) and DBTTs lower than about −73° C. (−100° F.), and more preferably are constructed from steels containing less than about 3 wt % nickel and having tensile strengths greater than about 1000 MPa (145 ksi) and DBTTs lower than about −73° C. (−100° F.). Furthermore, flare line 51, collection header line 52, lateral line 53, flare scrubber 54, and any additional associated piping or systems that would be exposed to the same cryogenic temperatures as flare system 50 are preferably constructed from the ultra-high strength, low alloy steels with excellent cryogenic temperature toughness described herein. Other components of flare system 50 may also be constructed from the ultra-high strength, low alloy steels with excellent cryogenic temperature toughness described herein, or from other suitable materials.

The design criteria and method of construction of flare components and systems according to this invention are familiar to those skilled in the art, especially in view of the disclosure provided herein.

In addition to the other advantages of this invention, as discussed above, a flare system constructed according to this invention has good resistance to vibrations that can occur in flare systems when relieving rates are high.

Containers for Storage of Cryogenic Temperature Fluids

Containers constructed from materials comprising an ultra-high strength, low alloy steel containing less than 9 wt % nickel and having tensile strengths greater than 830 MPa (120 ksi) and DBTTs lower than about −73° C. (−100° F.) are provided. Preferably the ultra-high strength, low alloy steel contains less than about 7 wt % nickel, and more preferably contains less than about 5 wt % nickel. Preferably the ultra-high strength, low alloy steel has a tensile strength greater than about 860 MPa (125 ksi), and more preferably greater than about 900 MPa (130 ksi). Even more preferably, the containers of this invention are constructed from materials comprising an ultra-high strength, low alloy steel containing less than about 3 wt % nickel and having a tensile strength exceeding about 1000 MPa (145 ksi) and a DBTT lower than about −73° C. (−100° F.). Such containers are preferably constructed from the ultra-high strength, low alloy steels with excellent cryogenic temperature toughness described herein.

In addition to the other advantages of this invention, as discussed above, i.e., less overall weight with concomitant savings in transport, handling, and substructure requirements, the excellent cryogenic temperature toughness of storage containers of this invention is especially advantageous for cylinders that are frequently handled and transported for refill, such as cylinders for storage of $CO_2$ used in the food and beverage industry. Industry plans have recently been announced to make bulk sales of $CO_2$ at cold temperatures to avoid the high pressure of compressed gas. Storage containers and cylinders according to this invention can be advantageously used to store and transport liquefied $CO_2$ at optimized conditions.

The design criteria and method of construction of containers for storage of cryogenic temperature fluids according to this invention are familiar to those skilled in the art, especially in view of the disclosure provided herein.

Pipes

Figure 6:
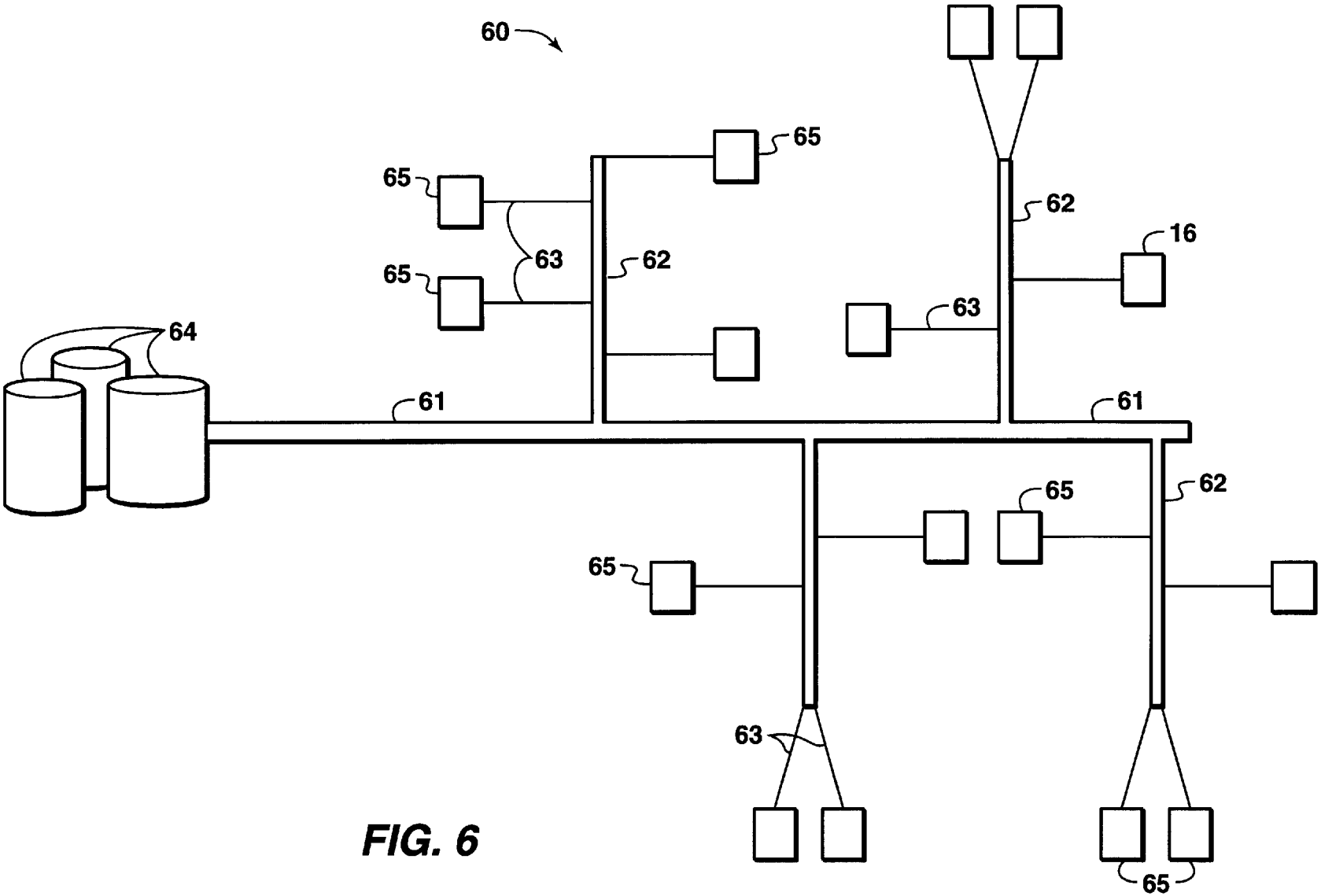
FIG. 6 illustrates a flowline distribution network system according to the present invention.

Flowline distribution network systems, comprising pipes constructed from materials comprising an ultra-high strength, low alloy steel containing less than 9 wt % nickel and having tensile strengths greater than 830 MPa (120 ksi) and DBTTs lower than about −73° C. (−100° F.) are provided. Preferably the ultra-high strength, low alloy steel contains less than about 7 wt % nickel, and more preferably contains less than about 5 wt % nickel. Preferably the ultra-high strength, low alloy steel has a tensile strength greater than about 860 MPa (125 ksi), and more preferably greater than about 900 MPa (130 ksi). Even more preferably, the flowline distribution network system pipes of this invention are constructed from materials comprising an ultra-high strength, low alloy steel containing less than about 3 wt % nickel and having a tensile strength exceeding about 1000 MPa (145 ksi) and a DBTT lower than about −73° C. (−100° F.). Such pipes are preferably constructed from the ultra-high strength, low alloy steels with excellent cryogenic temperature toughness described herein. FIG. 6 illustrates a flowline distribution network system 60 according to the present invention. In one embodiment, flowline distribution network system 60 includes piping, such as primary distribution pipes 61, secondary distribution pipes 62, and tertiary distribution pipes 63, and includes main storage containers 64, and end use storage containers 65. Main storage containers 64 and end use storage containers 65 are all designed for cryogenic service, i.e., appropriate insulation is provided. Any appropriate insulation type may be used, for example, without thereby limiting this invention, high-vacuum insulation, expanded foam, gas-filled powders and fibrous materials, evacuated powders, or multi-layer insulation. Selection of an appropriate insulation depends on performance requirements, as is familiar to those skilled in the art of cryogenic engineering. Main storage containers 64, piping, such as primary distribution pipes 61, secondary distribution pipes 62, and tertiary distribution pipes 63, and end use storage containers 65 are preferably constructed from steels containing less than 9 wt % nickel and having tensile strengths greater than 830 MPa (120 ksi) and DBTTs lower than about −73° C. (−100° F.), and more preferably are constructed from steels containing less than about 3 wt % nickel and having tensile strengths greater than about 1000 MPa (145 ksi) and DBTTs lower than about −73° C. (−100° F.). Furthermore, main storage containers 64, piping, such as primary distribution pipes 61, secondary distribution pipes 62, and tertiary distribution pipes 63, and end use storage containers 65 are preferably constructed from the ultra-high strength, low alloy steels with excellent cryogenic temperature toughness described herein. Other components of distribution network system 60 may be constructed from the ultra-high strength, low alloy steels with excellent cryogenic temperature toughness described herein or from other suitable materials.

The ability to distribute fluids that are to be used in the cryogenic temperature condition via a flowline distribution network system allows for smaller on-site storage containers than would be necessary if the fluid had to be transported via tanker truck or railway. The primary advantage is a reduction in required storage due to the fact that there is continual feed, rather than periodic delivery, of the pressurized, cryogenic temperature fluid.

The design criteria and method of construction of pipes for flowline distribution network systems for cryogenic temperature fluids according to this invention are familiar to those skilled in the art, especially in view of the disclosure provided herein.

The process components, containers, and pipes of this invention are advantageously used for containing and transporting pressurized, cryogenic temperature fluids or cryogenic temperature fluids at atmospheric pressure. Additionally, the process components, containers, and pipes of this invention are advantageously used for containing and transporting pressurized, non-cryogenic temperature fluids.

While the foregoing invention has been described in terms of one or more preferred embodiments, it should be understood that other modifications may be made without departing from the scope of the invention, which is set forth in the following claims.

Glossary of terms

| | |
|---|---|
| $Ac_1$ transformation temperature: | the temperature at which austenite begins to form during heating; |
| $Ac_3$ transformation temperature: | the temperature at which transformation of ferrite to austenite is completed during heating; |
| $Ar_1$ transformation temperature: | the temperature at which transformation of austenite to ferrite or to ferrite plus cementite is completed during cooling; |
| $Ar_3$ transformation temperature: | the temperature at which austenite begins to transform to ferrite during cooling; |
| CFZ: | controlled freeze zone; |
| conventional LNG: | liquefied natural gas at about atmospheric pressure and about −162° C. (−260° F.); |
| cooling rate: | cooling rate at the center, or substantially at the center, of the plate thickness; |
| cryogenic temperature: | any temperature lower than about −40° C. (−40° F.); |
| CTOD: | crack tip opening displacement; |
| DBTT (Ductile to Brittle Transition Temperature): | delineates the two fracture regimes in structural steels; at temperatures below the DBTT, failure tends to occur by low energy cleavage (brittle) fracture, while at temperatures above the DBTT, failure tends to occur by high energy ductile fracture; |
| essentially: | substantially 100 vol %; |
| GMAW: | gas metal arc welding; |
| hardening particles | one or more of ϵ-copper, $Mo_2C$, or the carbides and carbonitrides of niobium and vanadium; |
| HAZ: | heat affected zone; |
| intercritical temperature range: | from about the $Ac_1$ transformation temperature to about the $Ac_3$ transformation temperature on heating, and from about the $Ar_3$ transformation temperature to about the $Ar_1$ transformation temperature on cooling; |
| $K_{IC}$: | critical stress intensity factor; |
| kJ: | kilojoule; |
| low alloy steel: | a steel containing iron and less than about 10 wt % total alloy additives; |
| MA: | martensite-austenite; |
| maximum allowable flaw size: | critical flaw length and depth; |
| $Mo_2C$: | a form of molybdenum carbide; |
| $M_S$ transformation temperature: | the temperature at which transformation of austenite to martensite starts during cooling; |
| pressurized liquefied natural gas (PLNG): | liquefied natural gas at a pressure of about 1035 kPa (150 psia) to about 7590 kPa (1100 psia) and at a temperature of about −123° C. (−190° F.) to about −62° C. (−80° F.); |
| ppm: | parts-per-million; |
| predominantly: | at least about 50 volume percent; |
| quenching: | accelerated cooling by any means whereby a fluid selected for its tendency to increase the cooling rate of the steel is utilized, as opposed to air cooling; |
| Quench Stop Temperature (QST): | the highest, or substantially the highest, temperature reached at the surface of the plate, after quenching is stopped, because of heat transmitted from the mid-thickness of the plate; |
| QST: | Quench Stop Temperature; |
| slab: | a piece of steel having any dimensions; |
| tensile strength: | in tensile testing, the ratio of maximum load to original cross-sectional area; |
| TIG welding: | tungsten inert gas welding; |
| $T_{nr}$ temperature: | the temperature below which austenite does not recrystallize; |
| USPTO: | United States Patent and Trademark Office; and |
| weldment: | a welded joint, including: (i) the weld metal, (ii) the heat-affected zone (HAZ), and (iii) the base metal in the "near vicinity" of the HAZ. The portion of the base metal that is considered within the "near vicinity" of the HAZ, and |

-continued

| Glossary of terms |
| --- |
| therefore, a part of the weldment, varies depending on factors known to those skilled in the art, for example, without limitation, the width of the weldment, the size of the item that was welded, the number of weldments required to fabricate the item, and the distance between weldments. |

We claim:

1. A heat exchanger system comprising:

(a) a heat exchanger body suitable for containing a fluid at a pressure higher than about 1035 kPa (150 psia) and a temperature lower than about −40° C. (−40° F.), said heat exchanger body being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized fluid; and (b) a plurality of baffles.

2. A heat exchanger system comprising:

(a) a heat exchanger body suitable for containing pressurized liquefied natural gas at a pressure of about 1035 kPa (150 psia) to about 7590 kPa ( 1100 psia) and at a temperature of about −123° C. (−190° F.) to about −62° C. (−80° F.), said heat exchanger body being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized liquefied natural gas; and (b) a plurality of baffles.

3. A condenser system comprising:

(a) a condenser vessel suitable for containing a fluid at a pressure higher than about 1035 kPa (150 psia) and a temperature lower than about −40° C. (−40° F.), said condenser vessel being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized fluid; and (b) heat exchange means.

4. A vaporizer system comprising:

(a) a vaporizer vessel suitable for containing a fluid at a pressure higher than about 1035 kPa (150 psia) and a temperature lower than about −40° C. (−40° F.), said vaporizer vessel being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized fluid; and b) heat exchange means.

5. A separator system comprising:

(a) a separator vessel suitable for containing a fluid at a pressure higher than about 1035 kPa (150 psia) and a temperature lower than about −40° C. (−40° F.), said separator vessel being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized fluid; and (b) at least one isolation baffle.

6. A separator system comprising:

(a) a separator vessel suitable for containing pressurized liquefied natural gas at a pressure of about 1035 kPa (150 psia) to about 7590 kPa (1100 psia) and at a temperature of about −123° C. (−190° F.) to about −62° C. (−80° F.), said separator vessel being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized liquefied natural gas; and (b) at least one isolation baffle.

7. A process column system comprising:

(a) a process column suitable for containing a fluid at a pressure higher than about 1035 kPa (150 psia) and a temperature lower than about −40° C. (−40° F.), said process column being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized fluid; and (b) packing.

8. A process column system comprising:

(a) a process column suitable for containing pressurized liquefied natural gas at a pressure of about 1035 kPa (150 psia) to about 7590 kPa (1100 psia) and at a temperature of about −123° C. (−190° F.) to about −62° C. (−80° F.), said process column being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized liquefied natural gas; and (b) packing.

9. A pump system comprising:

(a) a pump casing suitable for containing a fluid at a pressure higher than about 1035 kPa (150 psia) and a temperature lower than about −40° C. (−40° F.), said pump casing being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized fluid; and (b) a drive coupling.

10. A pump system comprising:

(a) a pump casing suitable for containing pressurized liquefied natural gas at a pressure of about 1035 kPa (150 psia) to about 7590 kPa (1100 psia) and at a temperature of about −123° C. (−190° F.) to about −62° C. (−80° F.), said pump casing being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized liquefied natural gas; and (b) a drive coupling.

11. A flare system comprising:

(a) a flare line suitable for containing a fluid at a pressure higher than about 1035 kPa (150 psia) and a temperature lower than about −40° C. (−40° F.), said flare line being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized fluid; and (b) a flare scrubber.

12. A flare system comprising:

(a) a flare line suitable for containing pressurized liquefied natural gas at a pressure of about 1035 kPa (150 psia) to about 7590 kPa (1100 psia) and at a temperature of about −123° C. (−190° F.) to about −62° C. (−80° F.), said flare line being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized liquefied natural gas; and (b) a flare scrubber.

13. A flowline distribution network system comprising:

(a) at least one storage container suitable for containing a fluid at a pressure higher than about 1035 kPa (150 psia) and a temperature lower than about −40° C. (−40° F.), said at least one storage container being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized fluid; and (b) at least one distribution pipe.

14. A flowline distribution network system comprising:

(a) at least one distribution pipe suitable for containing a fluid at a pressure higher than about 1035 kPa (150 psia) and a temperature lower than about −40° C. (−40° F.), said at least one distribution pipe being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized fluid; and (b) at least one storage container.

15. A flowline distribution network system comprising:

(a) at least one storage container suitable for containing pressurized liquefied natural gas at a pressure of about 1035 kPa (150 psia) to about 7590 kPa (1100 psia) and at a temperature of about −123° C. (−190° F.) to about −62° C. (−80° F.), said storage container being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized liquefied natural gas; and (b) at least one distribution pipe.

16. A flowline distribution network system comprising:

(a) at least one distribution pipe suitable for containing pressurized liquefied natural gas at a pressure of about 1035 kPa (150 psia) to about 7590 kPa (1100 psia) and at a temperature of about −123° C. (−190° F.) to about −62° C. (−80° F.), said distribution pipe being constructed by joining together a plurality of discrete plates of materials comprising an ultra-high strength, low alloy steel containing less than 9 wt % nickel and having a tensile strength greater than 830 MPa (120 ksi) and a DBTT lower than about −73° C. (−100° F.), wherein joints between said discrete plates have adequate strength and toughness at said pressure and temperature conditions to contain said pressurized liquefied natural gas; and (b) at least one storage container.

* * * * *